US007716940B2

(12) United States Patent
Farnworth et al.

(10) Patent No.: US 7,716,940 B2
(45) Date of Patent: May 18, 2010

(54) GAS DISTRIBUTION GARMENT HAVING A SPACER ELEMENT

(75) Inventors: Brian Farnworth, Burnaby (CA); Paul Dacey, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 917 days.

(21) Appl. No.: 11/347,533

(22) Filed: Feb. 3, 2006

(65) Prior Publication Data

US 2006/0174392 A1 Aug. 10, 2006

Related U.S. Application Data

(63) Continuation-in-part of application No. 10/913,975, filed on Aug. 6, 2004.

(51) Int. Cl.
*F25D 23/12* (2006.01)

(52) U.S. Cl. ..... 62/259.3

(58) Field of Classification Search ..... 62/259.3; 2/2.5, 81, 102, 458, 459
See application file for complete search history.

(56) References Cited

U.S. PATENT DOCUMENTS

| | | | | |
|---|---|---|---|---|
| 2,789,076 A | | 4/1957 | Frieder et at. | 154/52.5 |
| 4,146,933 A | * | 4/1979 | Jenkins et al. | 2/458 |
| 4,185,327 A | | 1/1980 | Markve | |
| 4,242,769 A | | 1/1981 | Rayfield et al. | |
| 4,583,247 A | | 4/1986 | Fingerhut et al. | 2/69 |
| 4,685,155 A | | 8/1987 | Fingerhut et al. | 2/272 |
| 4,914,752 A | | 4/1990 | Hinson et al. | 2/2 |
| 5,072,455 A | | 12/1991 | St. Ours | 2/81 |
| 5,243,706 A | | 9/1993 | Frim et al. | 2/2 |
| 5,255,390 A | | 10/1993 | Gross et al. | |
| 5,334,436 A | | 8/1994 | Hobbs et al. | 428/195 |

(Continued)

FOREIGN PATENT DOCUMENTS

DE 692 245 6/1940

(Continued)

OTHER PUBLICATIONS

J. W. Kauffman, Naval Air Warfare Center Report NAWCADPAX-99-92-TR, "Techniques for Estimating Ventilation Requirements for Personal Air-Cooling Systems".

(Continued)

*Primary Examiner*—Melvin Jones
(74) *Attorney, Agent, or Firm*—Dianne Burkhard

(57) ABSTRACT

A garment for cooling the body of a wearer is described which comprises a substantially gas impermeable first substrate and a gas-permeable second substrate attached to form a cavity. At least one spacer element is provided between the first and second substrates to maintain gas flow in regions likely to be subjected to compression, e.g. by the body of a wear. At least one of the first and second substrates preferably comprises a plurality of raised protrusions on a surface within the cavity, and the gas permeable second substrate comprises a plurality of raised protrusions on the surface external to the cavity and proximate to the body of the wearer. The cavity is adapted to be connected to a gas supply such that the gas flows into the cavity and exits the cavity through the gas permeable second substrate. The cooling garment is light weight and conformable, and may be non-tethered for portability.

44 Claims, 18 Drawing Sheets

U.S. PATENT DOCUMENTS

| | | | | |
|---|---|---|---|---|
| 5,415,222 | A | 5/1995 | Colvin et al. | |
| 5,421,326 | A | 6/1995 | Rankin et al. | 128/201.19 |
| 5,564,124 | A | 10/1996 | Elsherif et al. | 2/69 |
| 5,755,110 | A | 5/1998 | Silvas | |
| 5,860,163 | A | 1/1999 | Aldridge | 2/81 |
| 5,970,519 | A * | 10/1999 | Weber | 2/81 |
| 6,105,382 | A | 8/2000 | Reason | |
| 6,134,714 | A | 10/2000 | Ulgene | 2/102 |
| 6,257,011 | B1 | 7/2001 | Siman-Tov et al. | |
| 6,260,201 | B1 | 7/2001 | Rankin | |
| 6,349,412 | B1 | 2/2002 | Dean | |
| 6,402,775 | B1 | 6/2002 | Bieberich | 607/104 |
| 6,481,015 | B1 * | 11/2002 | Lanier | 2/2.5 |
| 6,495,229 | B1 | 12/2002 | Carte et al. | 428/40.1 |
| 6,500,200 | B1 | 12/2002 | Kushuir | 607/104 |
| 6,532,762 | B2 | 3/2003 | Smith et al. | 62/480 |
| 6,602,811 | B1 | 8/2003 | Rock et al. | 442/312 |
| 6,858,068 | B2 | 2/2005 | Smith et al. | 96/127 |
| 7,043,766 | B1 | 5/2006 | Foreman et al. | |
| 7,117,687 | B2 | 10/2006 | Naaman | |
| 2001/0031595 | A1 | 10/2001 | Anderson et al. | 442/381 |
| 2004/0083526 | A1 | 5/2004 | Ichigaya | |

FOREIGN PATENT DOCUMENTS

| | | |
|---|---|---|
| EP | 0 490 347 | 6/1992 |
| EP | 0 948 908 | 10/1999 |
| EP | 1 101 429 | 5/2001 |

OTHER PUBLICATIONS

Mar. 23, 2007 USPTO Office Action issued to U.S. Appl. No. 10/913,975 (parent of U.S. Appl. No. 11/347,533).

Sep. 21, 2007 Response to Mar. 23, 2007 USPTO Office Action issued to U.S. Appl. No. 10/913,975 (parent of U.S. Appl. No. 11/347,533).

* cited by examiner

GAS DISTRIBUTION GARMENT HAVING A SPACER ELEMENT

RELATED APPLICATIONS

This application is a continuation-in-part of co-pending application Ser. No. 10/913,976, filed Aug. 6, 2004.

FIELD OF THE INVENTION

The present invention relates to a personal gas distribution garment, preferably a ventilated cooling garment. One embodiment is directed to a ventilated cooling garment for use by a wearer who is clad in a sealed overall suit and breathing system which is designed to protect the wearer from harmful chemical, biological, or other environmental hazards. It is also a function of the ventilated cooling garment of the present invention that it may be adapted to use filtered ambient air as the ventilating cooling medium. Further desirable attributes of the garment are high cooling power, low weight, low bulk, good flexibility, and high water vapour permeability, all of which contribute to the comfort of the wearer.

BACKGROUND OF THE INVENTION

It is well known that subjecting a person to prolonged periods of inadequate heat dissipation leads to an increase in body temperature (heat stress), indicated by undesirable effects such as discomfort, increased fatigue, decreased physical and intellectual performance and, in extreme cases, death. Body core temperatures in excess of 38° C. will, for example, lead to impaired decision making and increased reaction times whereas core temperatures in excess of 40° C. can cause physiological damage and fatalities. Increased body temperature can result from accumulation of heat from external sources, metabolic processes due to exertion, or a combination of both. Personnel such as fire-crews, "hazmat" operatives such as those working on toxic or generally hazardous cleanup operations, and chemical plant operatives handling hazardous products are potential victims of such heat stress. Such personnel have usually to wear virtually totally sealed garments which severely inhibit cooling effects that would naturally occur due to ambient air flow over the person's skin and clothing.

One possible measure to prevent the onset of heat stress is to blow a cooling gas, usually air, optionally cooled, over the subject's body, which results in cooling of the subject by a combination of convective and evaporative cooling. Studies of heat stress effects have shown that, to minimize such effects, the average desirable amount of cooling supplied to a subject undergoing moderate exertion is a minimum of 100 watts over the area of the torso. (Ref.: "Techniques for Estimating Ventilation Requirements for Personal Air-cooling Systems", J. W. Kaufman, Naval Air Warfare Center report NAWCADPAX-99-92-TR.)

Various approaches have been proposed to achieve "air-cooling" of subjects. For example, a system disclosed in U.S. Pat. No. 5,243,706 to Frim et al. is one such approach. The construction of the garment disclosed in this reference comprises an air-impermeable layer and an air distribution layer attached together with a corrugated mesh spacer layer in between. A further mesh spacer layer is positioned between the air-permeable layer and the body of the wearer. Cooling air is fed into the space between the air-permeable and air-impermeable layers, exits the air-permeable layer, and is distributed over the body of the wearer. Given the multi-layer construction of the garment and the inclusion of the corrugated spacer layer the flexibility, fit and comfort of the garment would be severely compromised and would be unlikely to meet the desirability criteria defined supra. Also, the relatively high resistance of the mesh fabrics to the flow of air necessitates a high pressure air source not readily available in a portable (or non-tethered) system.

U.S. Pat. No. 5,564,124 to Elsherif et al. discloses a personal ventilation apparatus which comprises a garment incorporating areas of air permeable material, such as open cell foam, to direct air to selected areas of the body. The system also comprises a battery powered blower unit which, optionally, includes thermoelectric heating or cooling devices or filters. Given the small areas over which the cooling air is vented relative to the total area of the torso, the cooling power of the garment disclosed in this reference is likely to be severely limited and not meet the cooling criteria previously defined.

U.S. Pat. No. 5,970,519 to Weber discloses a cooling garment for medical personnel which comprises a simple two-ply construction of an air-impermeable layer and an air-permeable layer, each having minimal thickness, defining a cavity into which air is blown. The cavity has no spacers, or intermediate material or structures except in the shoulder regions to prevent the collapse of the garment in that area when the garment is worn under a heavy apron such as a radiological shield. One distinct shortcoming of such a system is the absence of any intermediate layer to control airflow within the cavity resulting in uneven air distribution. A further shortcoming is the lack of a means for controlling air distribution between the inner air-permeable layer and the body of the wearer. The absence of such mechanisms may cause excessive cooling of some areas of the wearer's body, especially next to the air inlet port, while not supplying sufficient cooling in other areas. It is an objective of the present invention to overcome the shortcomings of the systems described above.

SUMMARY OF THE INVENTION

The present invention is directed to a gas distribution garment system which can be used with sealed garments such as are used in hazardous or toxic environments, as well as in other applications where the subject is exposed to high heat stress situations such as fire-fighters, clean room operatives or hospital theatre operatives. In a preferred embodiment, a gas distribution cooling garment system most conveniently comprises a vest which delivers cooling air only to the torso, but may also be a jacket with sleeves, a coverall with sleeves and legs, or any other form which delivers cooling air to specific areas of the body. For optimum comfort and cooling efficiency it is desirable that the garment conforms closely to the body shape of the wearer.

It is an object of the present invention that the cooling gas can be ambient air and that the air can be filtered to remove undesirable components from the cooling air. The cooling gas may also be passed through a heat exchanger to lower the temperature of the gas or through a de-humidifier to further increase its cooling capability. Furthermore, it has been determined that the most efficient cooling using air at an ambient temperature of about 35° C. is achieved by having an airflow of about 4 to 8 litres/second (l/s) over the subject and that the flow should be confined to layer no more than about 4 mm from the body of the subject.

Another object of the invention is to provide a high degree of cooling to the wearer, in addition to natural cooling experienced by the wearer, for an extended period of time. Preferably, more than 50 watts of additional cooling is provided over the torso for a period of at least about three hours; more preferably greater than about 80 watts of additional cooling, and further preferred greater than about 100 watts of additional cooling is provided over the torso of a wearer for a period of at least about three hours.

Yet a further object of the invention is that by the use of a gas distribution manifold and a plurality of discrete elements within the cavity defined by the substrates comprising the invention, substantially uniform cooling is achieved over the torso of the wearer.

It is a further object of the invention to provide a personal cooling system that is "non-tethered" and is light weight. In a preferred embodiment the total weight of the system is less than 3 kilograms.

A further object of the invention is to provide a cooling garment which comprises substrates having high water vapour permeability thereby minimizing the build-up of perspiration on the wearer's body even when the garment is not supplied with cooling gas.

One embodiment comprising the gas distribution garment of the present invention comprises a first and a second substrate sealed to define at least one cavity. The first substrate is substantially gas-impermeable but water-vapour-permeable. The second substrate is gas-permeable and preferably water-vapour-permeable. The surface of one or both substrates which is orientated towards the inside of the cavity are provided with a plurality of raised protrusions in the form of discrete elements, and the cavity is adapted to contain a gas distribution manifold which is in fluid connection with a gas supply system. The surface of the second substrate external to the cavity is also provided with a plurality of raised protrusions in the form of discrete elements.

In one preferred embodiment, the garment is in the form of a vest, and in use the second substrate will form the inside of the vest such that gas exiting the cavity through the gas-permeable second substrate will flow over the torso of the wearer. The plurality of discrete elements on the surface of the second substrate external to the cavity provides a space between the substrate and either the body of the wearer or any other garment worn thereon. The height of the discrete elements are chosen such that the space between the wearer's body, or any other clothing worn next to the wearer's body, and the gas-permeable second substrate is sufficiently wide to allow uniform flow of cooling gas but not so wide that it reduces the cooling effect of the gas. The in-plane spacing between the discrete elements is optimized to distribute the flow of gas exiting the cavity and give substantially uniform cooling of the torso.

The plurality of discrete elements on one or both surfaces of the substrates within the cavity provides a space between the surfaces thereby allowing optimal distribution of the cooling gas within the cavity, and therefore across the wearer's body.

In another embodiment, a gas distribution garment system comprises protrusions external to the cavity that are disposed on an additional substrate that is interposed between the body of the wearer and the external surface of the second substrate forming the cavity. The interposing substrate is preferably water-vapour-permeable and may be gas-permeable. The interposing layer may be attached to the substrates forming the cavity or detached from the cavity substrates.

The plurality of discrete elements contributes to increased conformability of the garment of the present invention by allowing flexing between protrusions compared with prior art garments which utilise mesh or mesh-like spacers. The flexibility of substrates suitable for use in the present invention, having a pattern or plurality of discrete elements thereon, is not substantially less than the flexibility of substrates without any discrete elements. In contrast, the three dimensional structures of the mesh or mesh-like spacers of the prior art lack flex points and they are generally bulky and stiff; therefore the use of these structures results in garments having poor flexibility and conformability.

Furthermore, the plurality of discrete elements also result in a garment construction having lower resistance to gas flow compared with garments of the prior art that utilise mesh or mesh like materials as spacers. Mesh spacers are constructed with material that can interfere with the air flow, whereas materials of the present invention have no intervening material between the discrete elements to interfere with air flow. The low resistance to gas flow afforded by the discrete elements facilitates the use of low power fans to supply cooling gas to the invention and obviates the need for the garment to be "tethered" to a power supply or a high pressure supply of cooling gas. Thus, a preferred embodiment comprises a "portable" or "non-tethered" gas distribution garment system which, as used herein, refers to a system which is not tethered to a (stationary) power supply or a high pressure gas supply. The cooling gas may be ambient air blown into the cavity by battery powered fans which may be optionally fitted with filter elements or other gas treatment systems to remove noxious or other undesirable contaminating components.

DETAILED DESCRIPTION OF THE INVENTION

Figure 1:
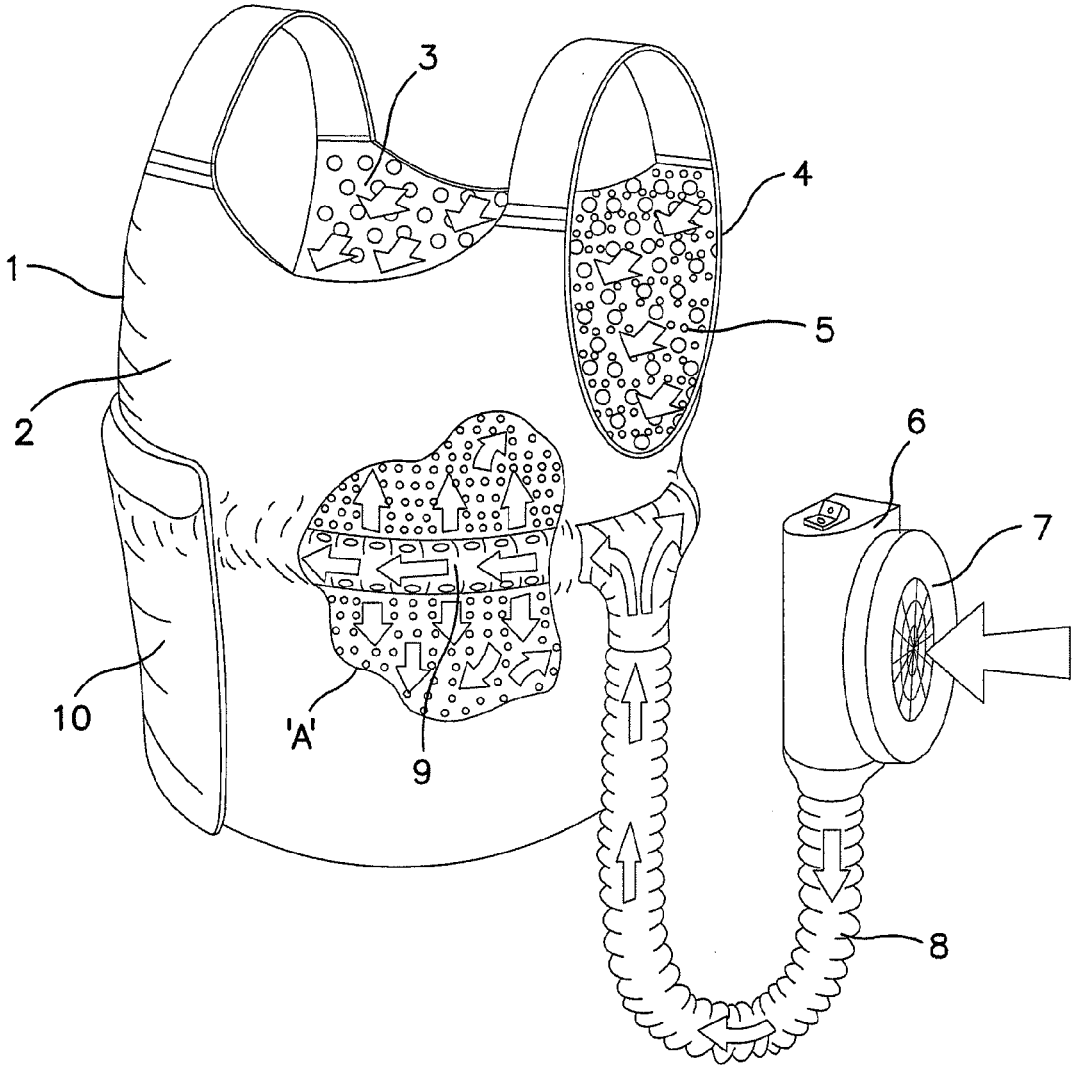
FIG. 1 represents an embodiment of the invention in the form of a vest and comprising a fan as a means to drive ambient air through a manifold into the cavity of the garment.

Referring to FIG. 1 which represents a preferred embodiment of the present invention the gas distribution cooling garment 1 comprises a substantially gas impermeable substrate 2 attached around it's periphery to a gas permeable substrate 3 to define a cavity, part of which is representationally shown by the cutaway section A. Substrate 3 has on its surface, which is external to the cavity and which is proximate to the body of the wearer, a plurality raised protrusions 4 in the form of discrete elements. Substrate 3 is rendered gas-permeable by perforating the substrate between said raised protrusions to give a plurality of holes 5 through which gas can vent from the cavity and pass over the body of the wearer. In one embodiment, the cooling gas is ambient air which is drawn by the fan 6 through optional filter 7 and fed through duct 8 to the air distribution manifold 9 and thence substantially uniformly throughout the volume of the cavity to exit via the perforations 5. The cooling garment is held in close contact to the body of the wearer by a fastening section 10 which may be fastened using "hook and loop" systems or other suitable methods known in the art.

The direction of air-flow through the system is generally represented by the sequence of block arrows which are included to aid comprehension of the invention and are not to be interpreted as restricting the scope of the invention.

Figure 2:
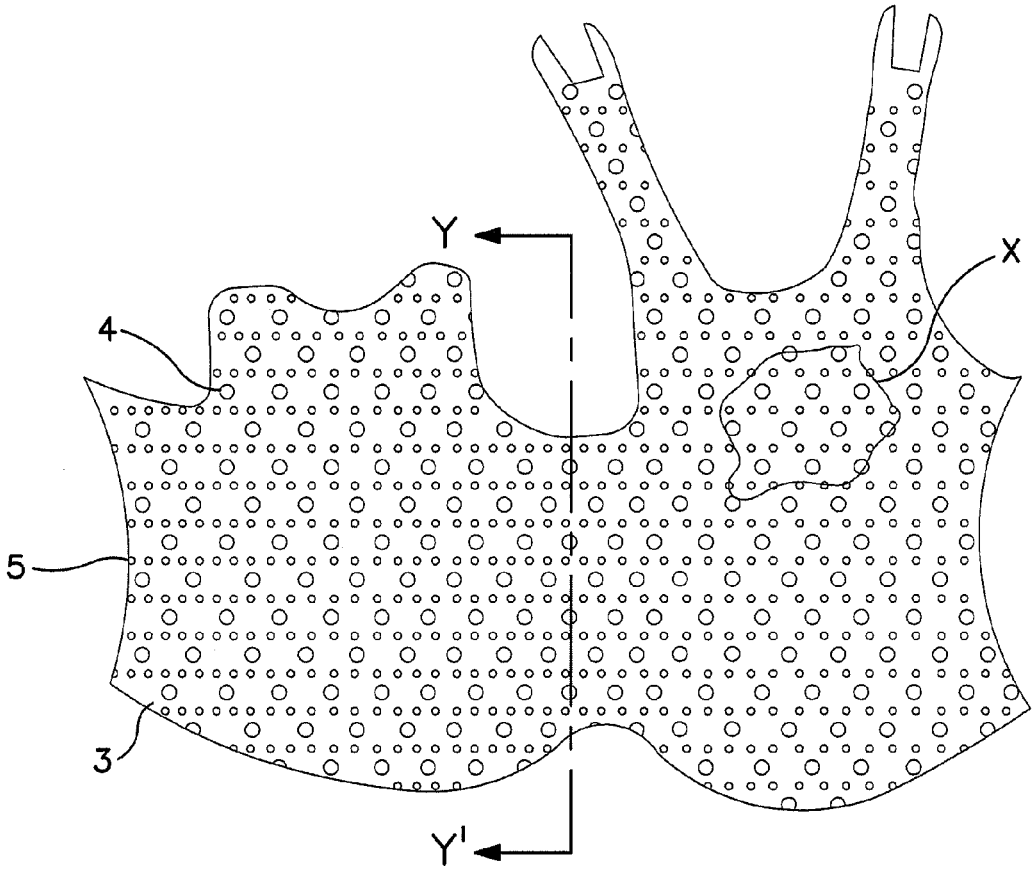
FIG. 2 is plan view of the body side of the vest illustrating the relative disposition of the discrete elements on the substrate and perforations in the said substrate.
Figure 3:
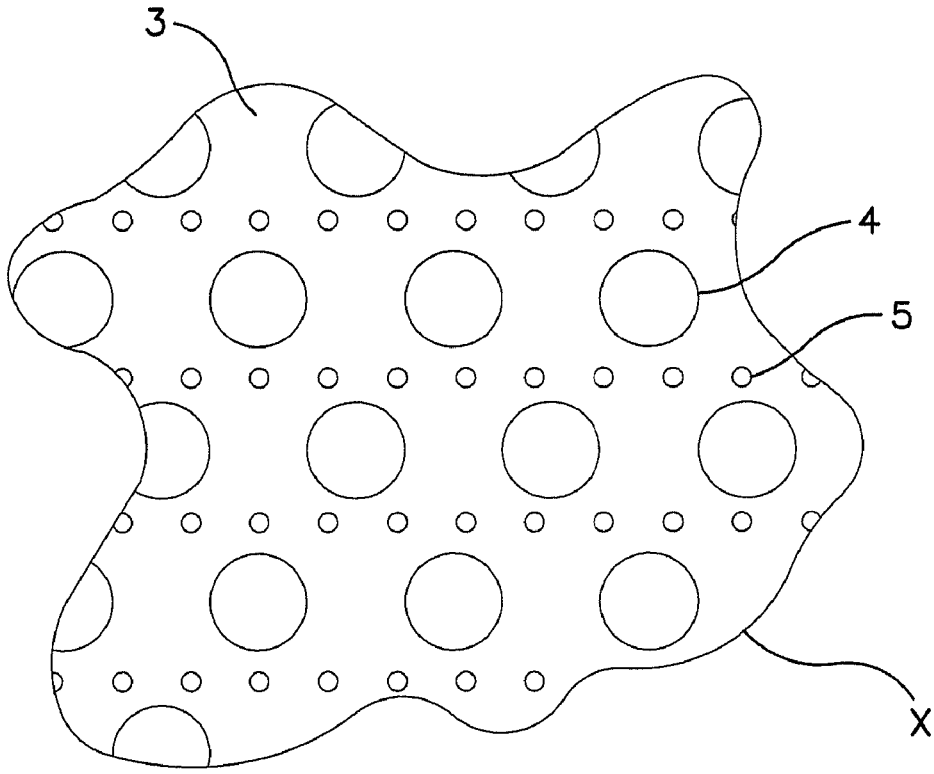
FIG. 3 is an enlarged view of area "X" in FIG. 2 in which the discrete elements comprise round protrusions.

FIG. 2 is a plan view of one embodiment of the present invention depicting the surface of the gas permeable substrate 3 that is worn proximate to the body of the wearer. The distribution of the discrete elements 4 and the perforations 5 are more clearly represented and are shown in detail in FIG. 3 which is a pictorial enlargement of area "X" in FIG. 2. Illustrative of one embodiment of the present invention, FIG. 3 shows the relative distribution (not to scale) of the discrete elements 4 and the perforations 5 on the surface of the substrate 3. In the embodiment represented, the discrete elements are shown as having circular cross-section in plan view which is not to be seen as limiting the invention. The raised protrusions may comprise other shapes such as cuboidal, conical, pyramidal, polyhedral, hemispherical or truncated hemispherical. By "discrete elements" it is meant a plurality of individual elements, that are substantially or essentially discontinuous or not connected. The discrete elements 4 are preferably soft and resilient but with limited compressibility for optimum comfort and maintenance of air flow. The discrete elements may comprise any material capable of maintaining space between substrate layers, or between a substrate and the body of a wearer, but preferably comprise a thermoplastic or thermosetting polymer selected from, for example, but not limited to silicone, polyester, polyurethane, polyalkene, polyamide, fluoropolymers or other similar materials known to one skilled in the art. Raised protrusions 4 may be applied to substrate 2 by any convenient means such as extrusion or screen printing or other methods known, for example, to one skilled in the art of surface coatings.

For optimal gas flow and cooling the raised protrusions preferably cover 50% or less of the area of the surface of substrate 3 which is proximate to the body of the wearer, a preferred coverage is less than 30% of the surface area and a more preferred coverage is less than 20%. It has been discovered by the inventor that, surprisingly, optimal cooling is achieved in systems wherein the height of the raised protrusions, preferably in the form of discrete elements 4, is in the range of about 1 mm to 20 mm, preferably in the range about 2 mm to 10 mm and more preferably in the range about 2 mm to 4 mm. Preferably, the raised protrusions 4 define a plurality of channels having a depth equivalent to the height of the protrusions, between the external surface of substrate 3 and the wearer. The cooling gas which exits through perforations 5 flows through the aforesaid channels and is distributed substantially uniformly over the body of the wearer.

The perforations 5 shown as circular in cross section may also be of other cross-sections and are preferably uniformly distributed over the surface of substrate 3 to maintain uniform gas-flow over the body of the wearer. The cross-sectional area of a single perforation is preferably equivalent to that of a circular perforation having a diameter of between about 1 mm and 2 mm. The perforations should be sufficient in number for substrate 3 to have an air permeability preferably of between about 10 and 100 $l\,m^{-2}\,s^{-1}$ at a pressure drop of about 100 Pa and more preferably of between about 60 and 70 $l\,m^{-2}\,s^{-1}$ at a pressure drop of about 100 Pa.

Figure 4:
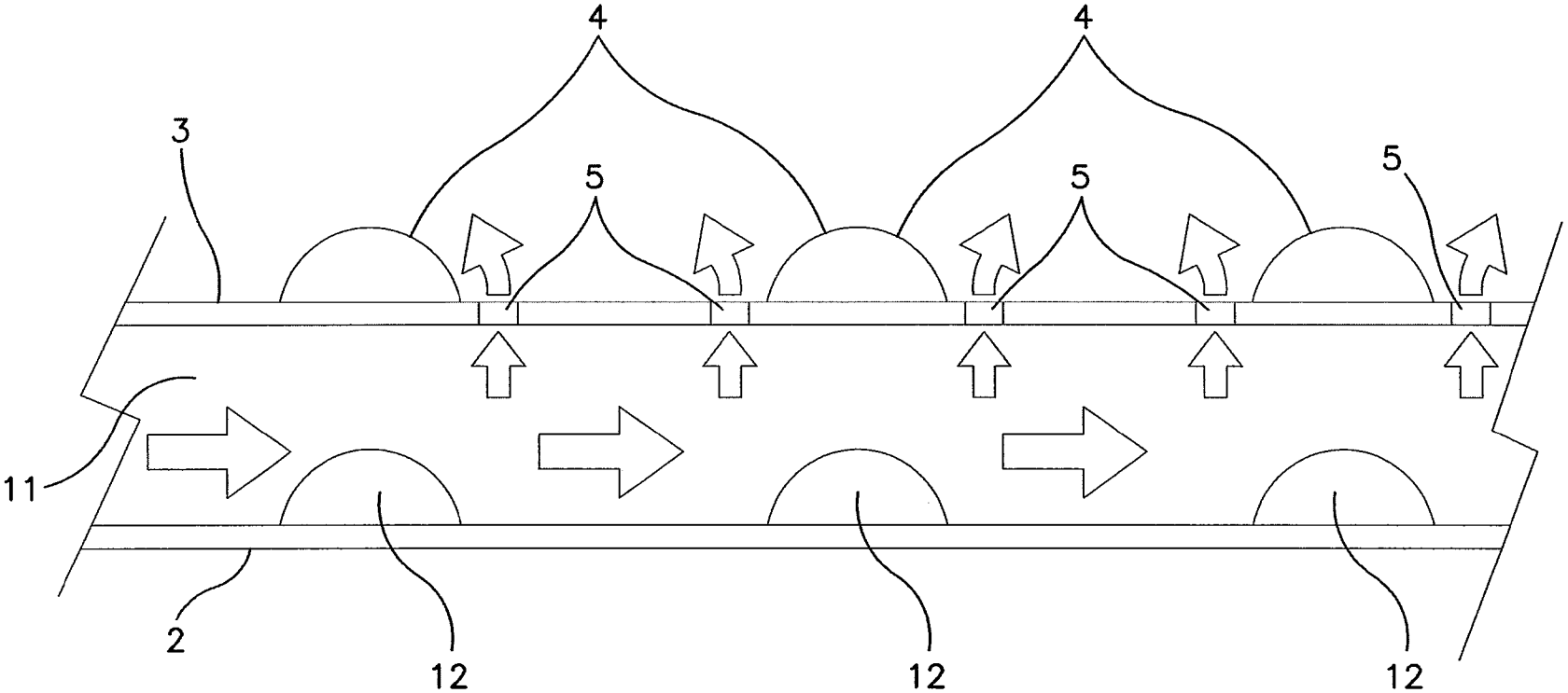
FIG. 4 is a representation of the cross-section of an embodiment of the invention wherein the discrete elements within the cavity are disposed on the gas-impermeable substrate.

FIG. 4 shows enlarged detail of a cross-sectional view in the direction of Y-Y' of FIG. 2 of an embodiment of the invention. Substrates 2 and 3 define cavity 11 into which the cooling gas is passed from the gas distribution manifold (not shown). The raised protrusions 4 which comprise discrete elements having a hemispherical profile are provided on the external surface of substrate 3, i.e. the surface which is external to cavity 11. When the garment is worn the protrusions 4 are in contact with the body of the wearer or in contact with an article of clothing, such as underwear or t-shirt, worn by the wearer.

Referring again to FIG. 4 it will be seen that this embodiment comprises a plurality of raised protrusion integral with the surface of substrate 2, disposed internal to cavity 11. These are in the form of hemispherical discrete elements 12 which are uniformly distributed over the surface of substrate 2 within cavity 11. Raised protrusions preferably in the form of discrete elements 12 cover preferably less than 50% of the area and, more preferably, less than 30% of the surface of substrate 2 which is internal to the cavity. A function of the discrete elements 12 disposed within the cavity, is to act as spacer members to prevent the collapse of cavity 11, for example, when heavy articles of clothing or a self contained breathing apparatus is worn over the cooling garment of the invention. A further function of the discrete elements 12 is to aid in the uniform distribution of the cooling gas throughout the cavity 11.

The height of the discrete elements 12 within the cavity is preferably in the range of about 1 mm to 20 mm. To minimise the thickness of the vest, and maximise its conformability and flexibility, and to ensure uniform distribution of the cooling gas through the cavity 11, a preferred height of the discrete elements may range from about 2 mm to 10 mm. The discrete elements 12 located within the cavity may comprise any suitable material but preferred materials are soft, resilient polymers having limited compressibility. The polymers may be thermosetting or thermoplastic and may be selected from a range of polymers such as silicones, polyurethanes, polyesters, polyamides, polyalkenes fluoropolymers or other polymers deemed suitable by one skilled in the art, and may be applied to the supporting substrate by extrusion, screen printing or any suitable method known to one skilled in the art.

Figure 5:
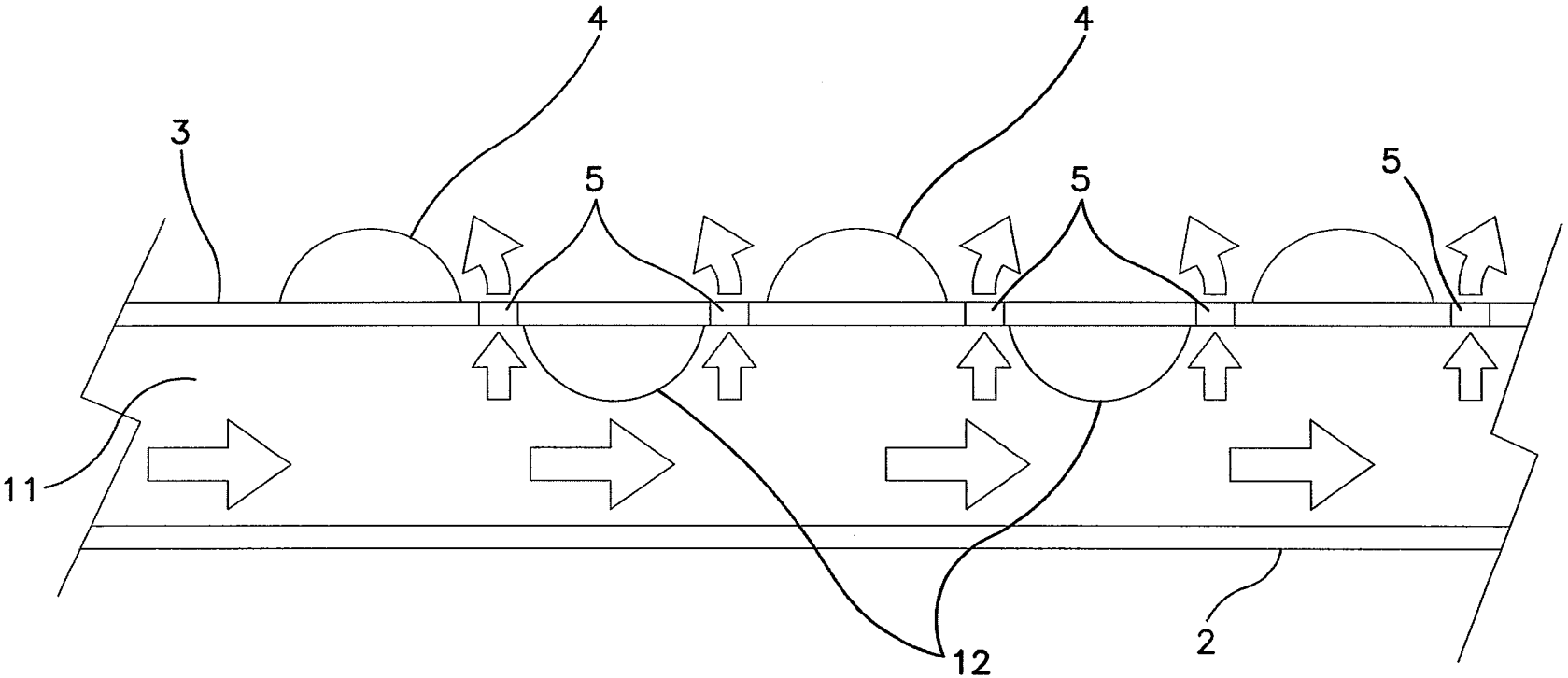
FIG. 5 is a representation of a cross-section of an embodiment of the invention in the direction Y-Y' of FIG. 2 wherein the discrete elements are disposed either side of the gas-permeable substrate.

A further embodiment of the invention is shown in FIG. 5 which is a cross-section of a garment having an alternative arrangement of raised protrusions in the form of discrete elements 12 within the cavity 11. In this embodiment the discrete elements 12 are located on the internal surface of substrate 3 and are positioned so as to be off-set from the protrusions 4 which are situated on the opposite surface of substrate 3. In a further embodiment the discrete elements 12 on the internal surface of substrate 3 may be in alignment with the position of protrusions 4 on the external surface of the substrate, while maintaining airflow through the perforations 5.

Substrate 2 is preferably substantially gas impermeable; by "substantially gas impermeable" is meant a substrate having less than about 10% of the gas permeability of the gas permeable second substrate. Preferred substrates have an air permeability of less that 10 l $m^{-2}s^{-1}$ at pressure of 100 Pa. Preferably, substrate 2 is also water vapour permeable. Substrate 3 may be a gas impermeable layer which has been perforated, or may be an intrinsically air permeable layer such as a laminate of microporous PTFE, a tightly woven textile, or a dense non-woven textile, with preferred constructions comprising an air permeability in the range of between about 10 and 100 l $m^{-2}s^{-1}$ as previously taught herein. Where perforated, substrate 3 may be rendered somewhat water-vapour-permeable by the perforations 5 but it is preferred that the material of construction of substrate 3 is inherently water-vapour permeable.

Substrates 2 and 3 may comprise single monolithic constructions or may comprise a plurality of layers of different materials chosen to impart the desired features to the substrates, such as air permeability and water vapour permeability. A preferred construction is a laminate of knitted or woven textile and an expanded polytetrafluoroethylene membrane coated with a water vapour permeable polymer. Such laminates are sold under the GORE-TEX® trade name by W.L. Gore and Associates Inc. Newark Del. Preferred water vapour permeable materials for use in the substrates of the present invention including both the gas impermeable substrate and the gas permeable substrate, may be comprised of a layer of a water-vapour permeable polymer such as polyurethane, polyester or microporous polyurethane or may comprise such polymers coated on or laminated to a textile construction. Preferred materials are those having water vapor evaporative resistance (Ret) values less than about 20 $m^2$ Pa $W^{-1}$ as measured according to ISO 11092. More preferred materials are those having Ret values less than about 15 $m^2$ Pa $W^{-1}$ as measured according to ISO 11092.

For maximum flexibility and conformability to the wearer's body-shape the substrates 2 and 3 should be as thin as possible whilst having sufficient robustness to withstand the stresses of use. Substrate 3 may comprise a monolithic single layer construction or a plurality of layers or a laminate comprising the same or different material that is chosen for substrate 2.

Figure 18:
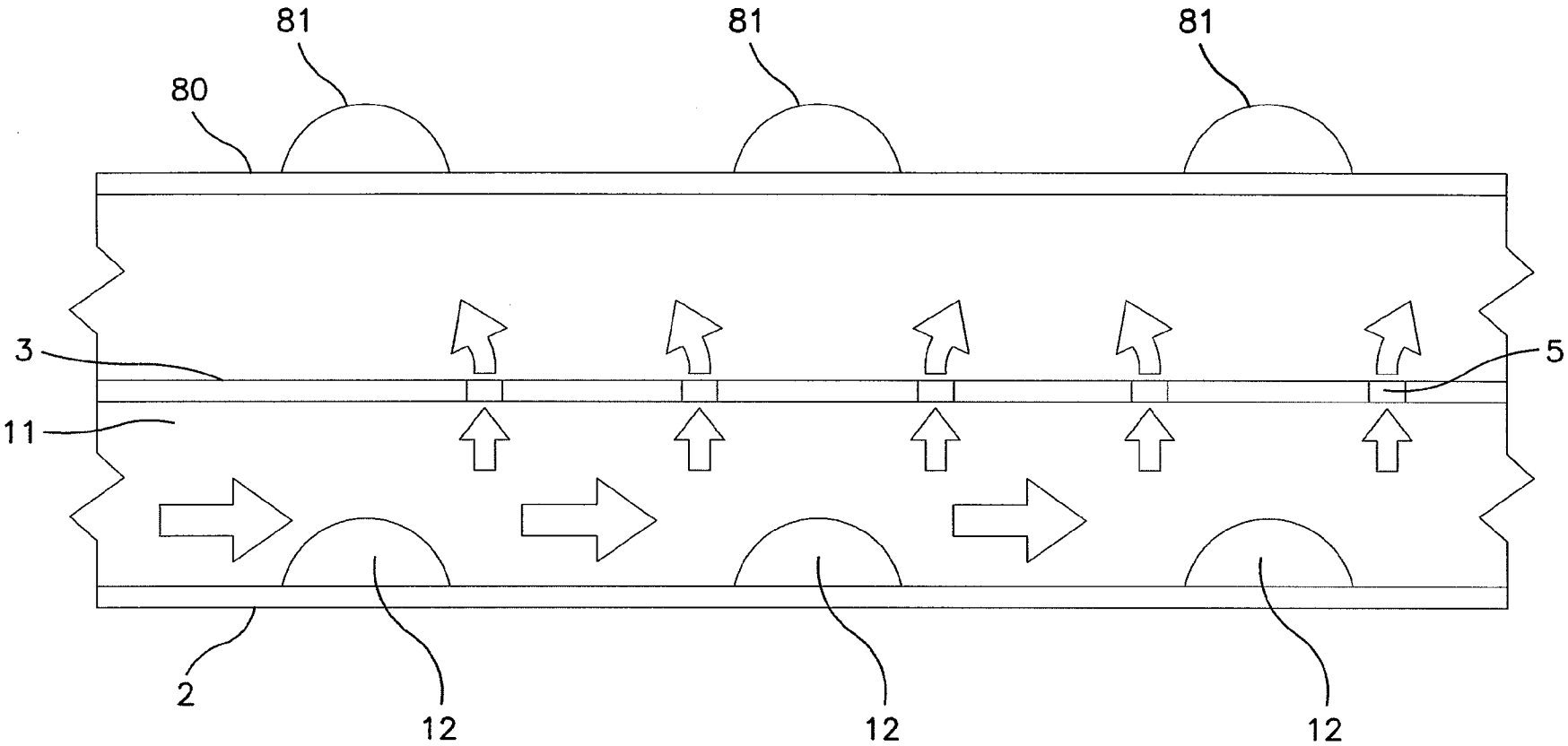
FIG. 18 is a representation of an alternate construction of the invention.

In an alternate construction of the present invention, referring to FIG. 18, a gas distribution garment system is formed wherein the plurality of raised protrusions external to the cavity are not disposed directly on the external cavity surface. The raised protrusions external to the cavity surface are disposed on an additional substrate 80 that is interposed between the body of the wearer and the external surface of the cavity. In a first embodiment of this alternate construction, the plurality of raised protrusions 81 external to the cavity surface are disposed on an additional substrate located between the external cavity substrate 3 and the skin of the wearer, and the raised protrusions are predominantly oriented towards the skin. The additional substrate may be any suitable woven, non-woven or knitted fabric which is air permeable. For example, a knitted undergarment worn separately from the gas distribution garment may comprise a plurality of raised protrusions 81 disposed on the inside of the undergarment directed toward the skin of the wearer. In this preferred embodiment, the additional substrate 80 comprising the raised protrusions is air permeable to enable the flow of air from the air permeable cavity substrate to flow through the additional substrate into close proximity with the wearer's skin.

In a second embodiment of this alternate construction, the additional substrate comprising the plurality of raised external to the cavity is also located between the body of the wearer and the external surface of the cavity. In this embodiment the plurality of raised protrusions are predominantly disposed on the additional substrate in an orientation that is away from the skin. The additional substrate may be any suitable woven, non-woven or knitted fabric which is water vapor permeable such as, for example, a knitted undergarment such as a T-shirt. In this embodiment, the additional substrate is water vapor permeable to permit the evaporation of water from the skin into the stream of air which is formed external to the cavity between the air permeable cavity substrate and the additional substrate comprising the raised protrusions. In this embodiment, the additional substrate is optionally air permeable. In an embodiment of the alternate construction of the present invention, the additional substrate may be permanently affixed to one or both of the substrates that form the cavity, or the additional substrate may be detachably affixed to the substrates, or the additional substrate may be separate from the substrates that form the cavity.

Figure 10:
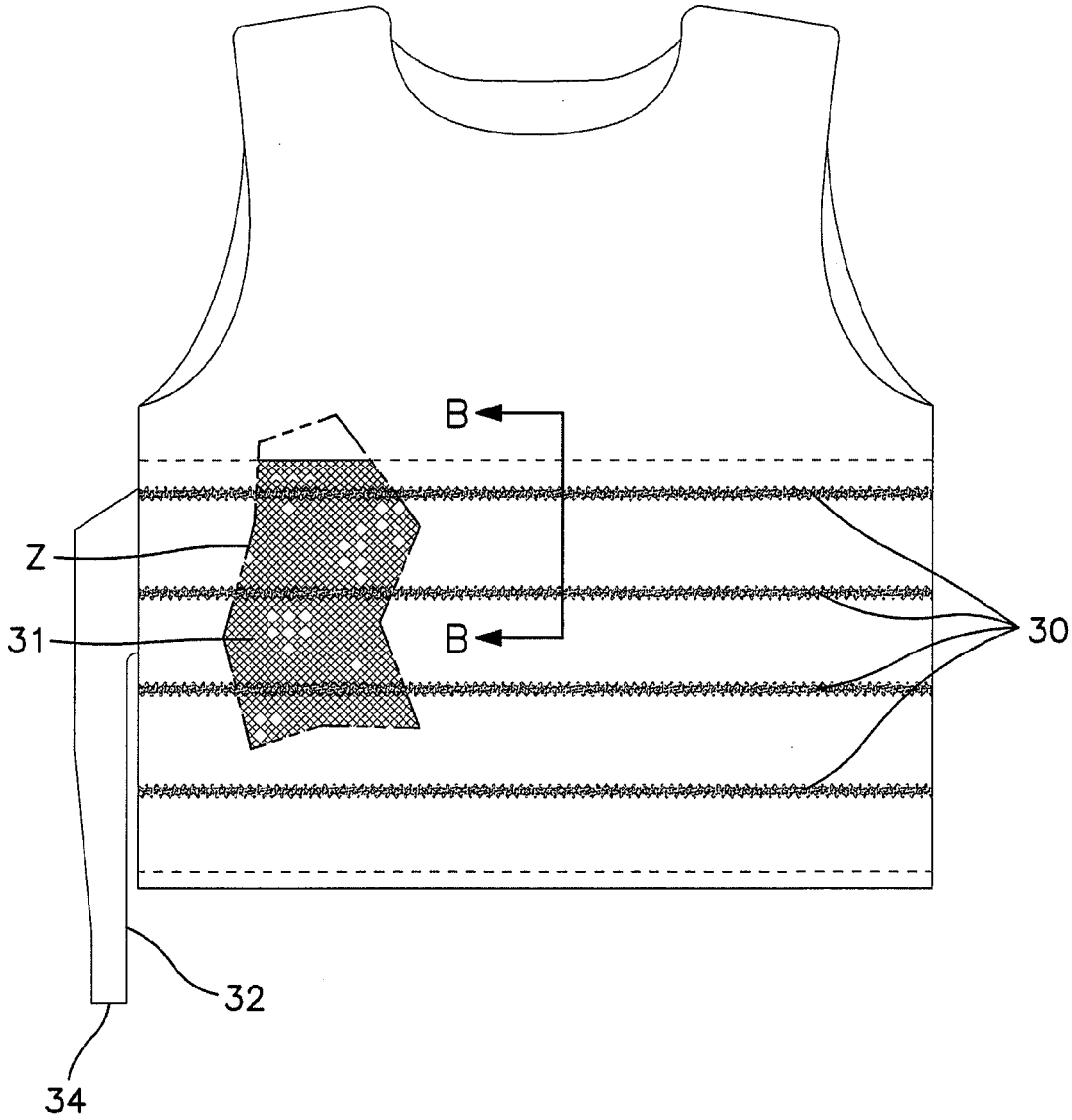
FIG. 10 is a plan view of an embodiment illustrating spacer elements within the cavity.
Figure 11:
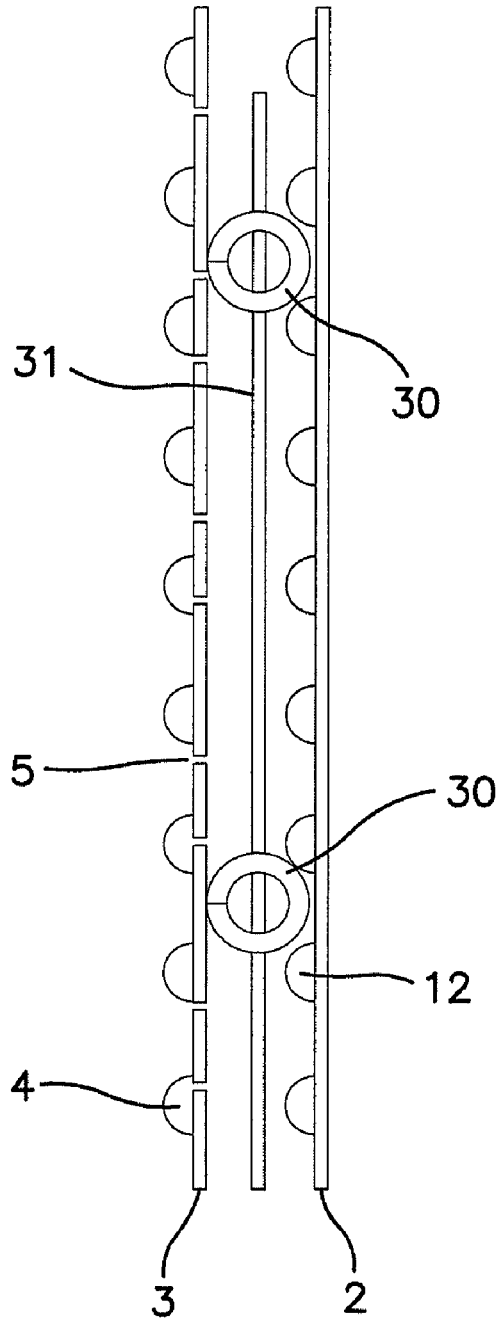
FIG. 11 is a representation of a cross-section of B'-B of FIG. 10 wherein the spacer element in the form of a helical coil and raised protrusions are disposed within the cavity.

In another embodiment of the present invention as exemplified by FIG. 10, in addition to raised protrusions, the cavity may further comprise at least one spacer element 30 placed between substrates of the cavity to maintain airflow in regions likely to be subject to compression, e.g. by the body of a wearer. For example, in one embodiment at least one spacer element 30 is placed within the cavity in portions corresponding to the abdomen of a wearer, side regions adjacent to the abdomen of a wearer, or both the abdomen and side regions as illustrated in FIG. 10. Therefore, spacer elements 30 are preferably load bearing. Preferred load bearing spacer elements are those capable of maintaining a suitable gap within the cavity when worn under relatively heavy gear such as but not limited to a ballistic vest, a back pack, a self-contained breathing apparatus, or the like. Spacer elements may have a height from about 1 to 30 mm, preferably 2 m to about 30 mm, or 3 mm to about 30 mm, and more preferably from about 4 mm to about 20 mm. Where spacer elements 30 are used in combination with the raised protrusions 12 (FIG. 11) it is preferred that the height of the spacer elements is greater than the height of the raised protrusions. FIG. 11 is a cross-sectional representation of B'-B from FIG. 10. Spacer elements 30 are positioned between the air permeable 3 and air impermeable substrates 2 that comprise the cavity of the gas distribution vest of FIG. 10. In this embodiment, air impermeable substrate 2 comprises raised protrusions 12 in the same region in which spacer elements 30 are incorporated.

Whereas the present invention is directed to a garment that is flexible and conformable, the spacer element preferably comprises a flexible material, a form having flex points, or a multiplicity of elements incorporated so as to maintain the flexibility of the garment. The form of the spacer element should be suitable for resisting compression and maintaining desired airflow distribution throughout the portion of the cavity. Examples include but are not limited to a helical coil, a plurality of helical-coils, flexible, perforated tubing, and shaped three-dimensional mesh.

Where the spacer element is a helical coil as shown in cut-away Z of FIG. 10, a preferred helical coil has a diameter between about 2 mm and 30 mm, also preferred from about 3 mm to 30 mm, more preferably from about 4 mm to about 20 mm. One suitable material for forming helical coils useful in the present invention includes polyvinylchloride. Such coils may be obtained from Factory Express, (Albuquerque, N. Mex.; such as part Nos. 1200 and 1240).

Where the spacer element is a coil, it may comprise, for example, a continuous length or a plurality of coil elements. Alternately, a spacer element comprising a helical coil may be a grid of overlapping coils.

Optionally, the at least one spacer element secured within the cavity is unattached to a cavity substrate. Alternately a spacer element may be affixed to one or both substrate surfaces within the cavity, for example, by adhesion, sewing or the like, or may be incorporated into the cavity by attachment to the cavity perimeter. In a further alternate embodiment, a spacer element may be supported by an additional layer, such as a planar mesh or a scrim which is incorporated into the cavity as exemplified by FIG. 11 at 31. For example, the additional layer may be incorporated into the cavity without attachment to a cavity substrate, by attachment to the cavity perimeter, or affixed to a cavity substrate. The spacer element is optionally affixed to the additional supporting layer by any known means such as sewing, gluing, and interweaving or entangling the spacer with the additional supporting layer. Materials suitable for forming the additional supporting layer include planar mesh or scrim and preferably do not significantly increase backpressure within the cavity.

In a further alternate embodiment comprising a spacer element, raised protrusions optionally may be omitted from the interior of the cavity in regions in which the spacer element is incorporated. Thus, in one embodiment, a gas distribution garment is formed comprising first and second substrates forming a cavity, a spacer element within the cavity in regions subject to compression, at least one of the first and second substrates comprising a plurality of raised protrusions on a surface within the cavity, and optionally comprising raised protrusions on a surface within the cavity in regions having a spacer element. In one preferred embodiment, at least one spacer element is disposed in a first region within the cavity and a plurality of raised protrusions on a substrate positioned within the cavity is disposed in a second region.

In still a further embodiment of the present invention, the spacer element may be used in place of the raised protrusions throughout the cavity formed by the first and second substrates. Thus, one embodiment of the present invention is directed to a gas distribution garment comprising a substantially gas impermeable first substrate and a gas-permeable second substrate attached around substrate peripheries forming a cavity therebetween, at least one spacer element disposed within the cavity, optionally affixed to at least one of the first and second substrates, and the gas permeable second substrate comprising a plurality of raised protrusions on the surface external to the cavity and proximate to the body of the wearer, wherein the cavity is adapted to be connected to a gas supply such that the gas flows into the cavity and exits the cavity through the gas permeable second substrate. In the embodiment where the spacer element is used in place of raised protrusions the preferred height of the space element is about 1 mm to 30 mm.

Figure 6:
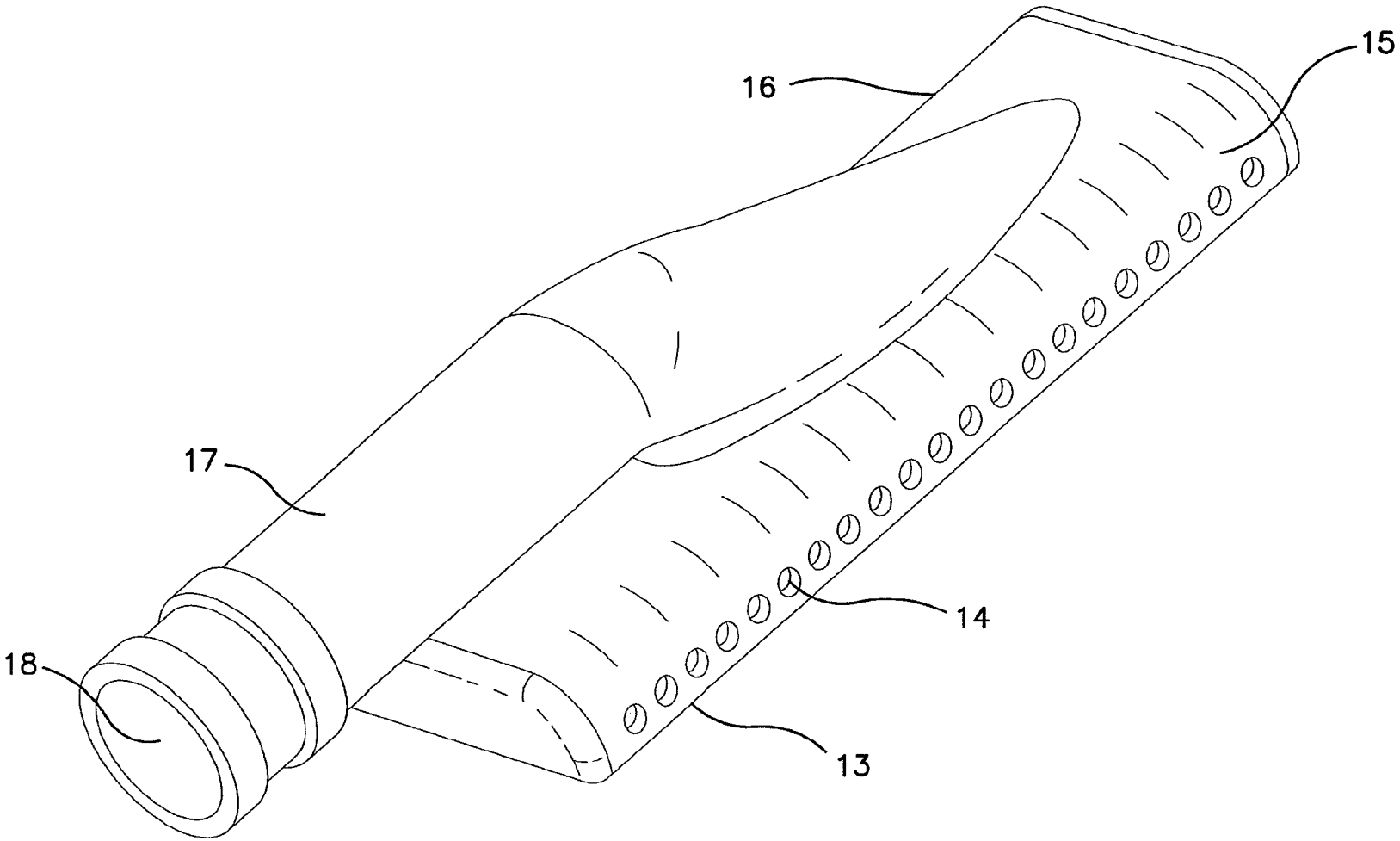
FIG. 6 is a representation of a gas distribution manifold for use in an embodiment of the invention.

Since the gas distribution garment of the present invention is preferably incorporated into a portable personal cooling system supported by a battery powered fan, it is preferred that minimal back pressure is created by the spacer element to maximize the efficiency of the system The cavity formed by the substrates is adapted for connection with a gas supply so that gas flows into the cavity and exits the cavity through the gas permeable substrate. A preferred means for such adaptation comprises a gas distribution manifold, substantially hollow in cross section, which is in fluid connection with the gas supply and comprises a series of perforations to allow gas to be distributed within at least part of the cavity. FIG. 6 is a representation of the construction of a gas distribution manifold for use in an embodiment of the invention. The manifold of FIG. 6 comprises a hollow elongate member 13 which is substantially rectangular in cross-section, though it should be understood that other cross-sectional shapes are suitable for use in the present invention Hollow member 13 is provided with a series of perforations 14 along the sides 15 and 16 and a gas feed duct 17. In use hollow member 13 is placed in the cavity of the garment with the duct 17 external to the cavity. The cooling gas is fed through the lumen 18 of duct 17 and is distributed into the cavity of the garment through perforations 14.

Figure 7:
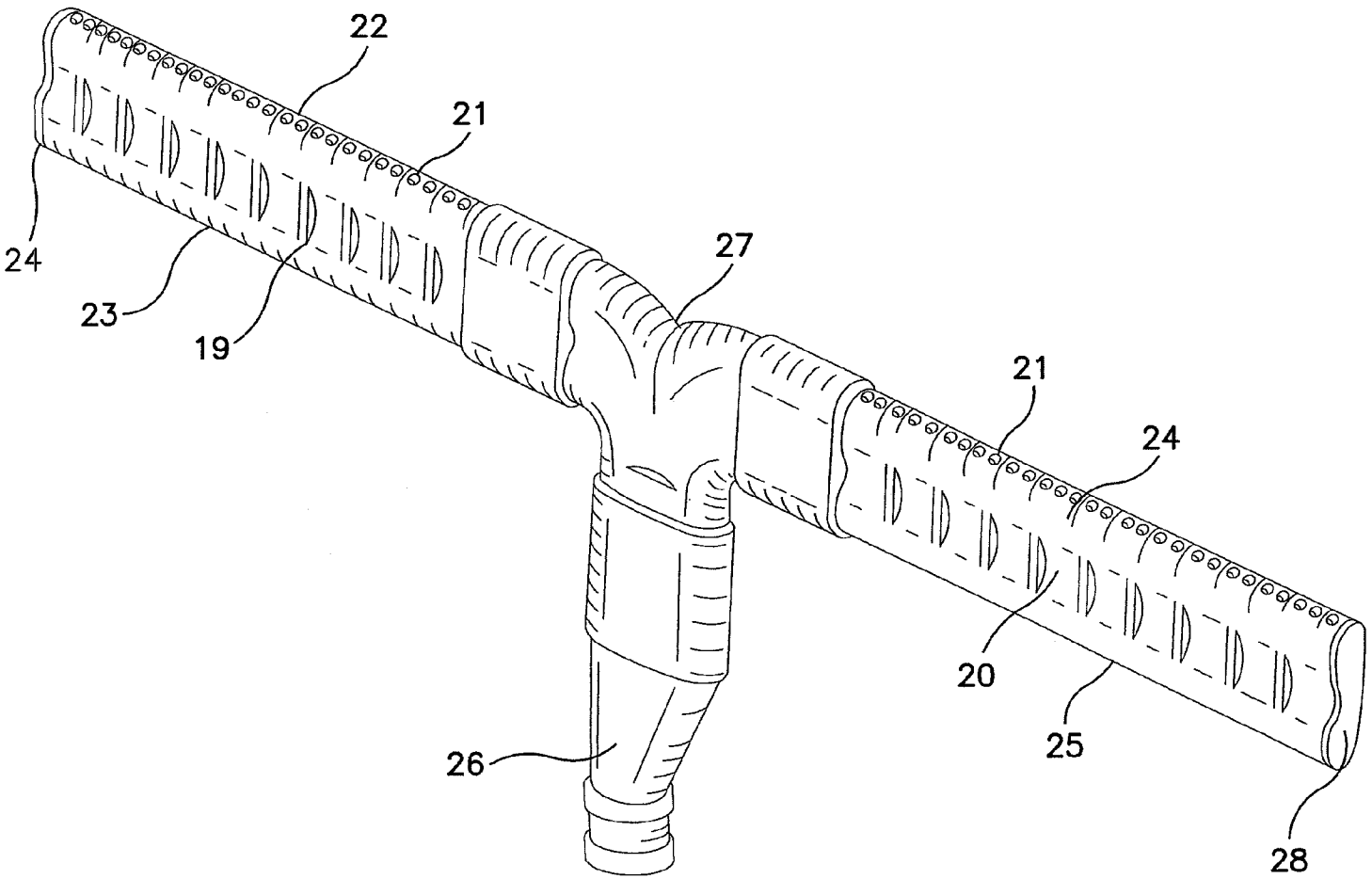
FIG. 7 is a representation of an alternative construction of a gas distribution manifold for use in an embodiment of the invention.

FIG. 7 is a representation of an alternative and preferred construction of a gas distribution manifold for use in the garment of the invention and corresponds to item 9 in FIG. 1. The construction comprises two hollow elongate members 19 and 20 which are substantially cylindrical in cross-section and have a series of perforations 21 along edges 22, 23, 24, and 25. Hollow members 19 and 20 are connected to gas feed duct 26 by union piece 27 and the ends members 19 and 20 remote from union piece 27 are closed off by blanking pieces 28 and 29.

In use, members 19 and 20 are preferably placed in the cavity of the garment such that one member is in the area of the garment which covers the front of the torso of the wearer and the other member is in the back area of the garment. Gas feed duct 26 is the representative embodiment is external to the cavity of the garment. Cooling gas fed into duct 26 is fed into both members 19 and 20 and is distributed into the cavity through perforations 21.

The members 19 and 20 maybe constructed of any suitable material known to one skilled in the art but for optimal comfort for the wearer the material should be soft and flexible and preferably resilient with only a slight degree of compressibility. Suitable materials include elastomeric materials such as polyurethane, polyester, or synthetic rubbers such as EPDM or SBR. It is preferable for the material to have a hardness in the range of 55-65 Shore A.

Figure 12:
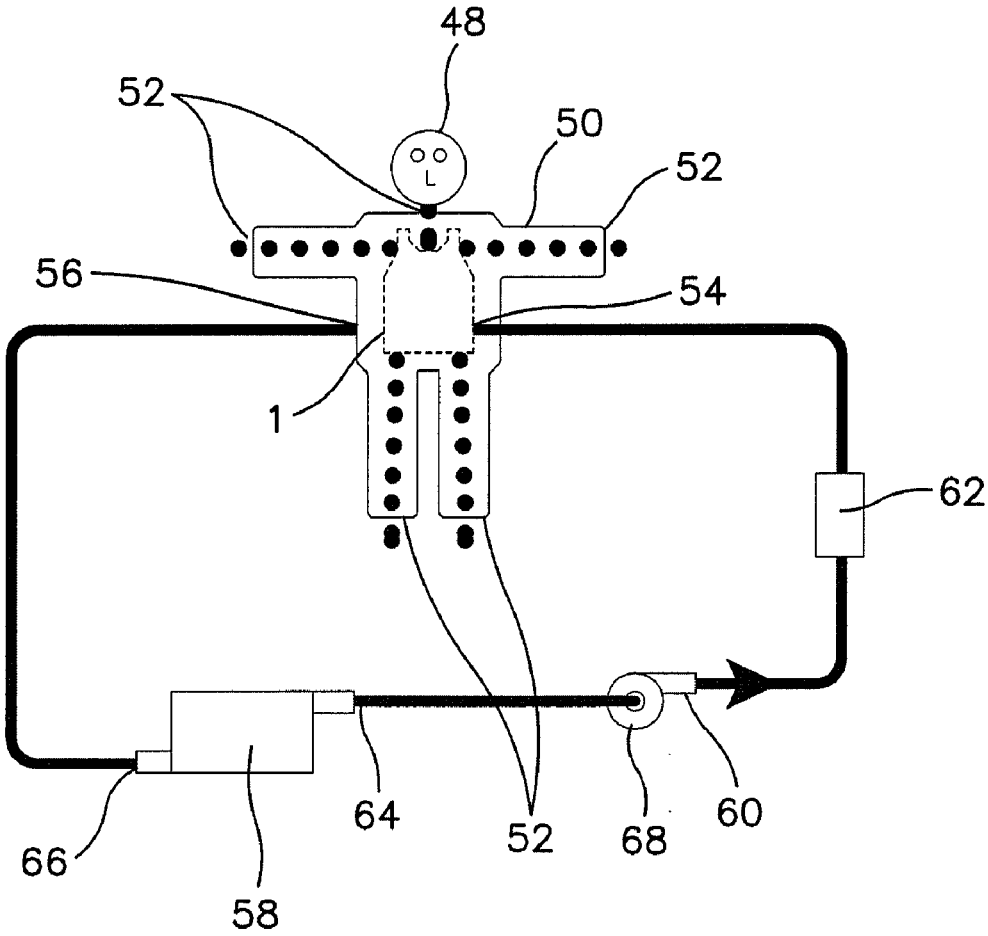
FIG. 12 is a schematic of a gas distribution garment connected to a gas conditioning component.
Figure 14:
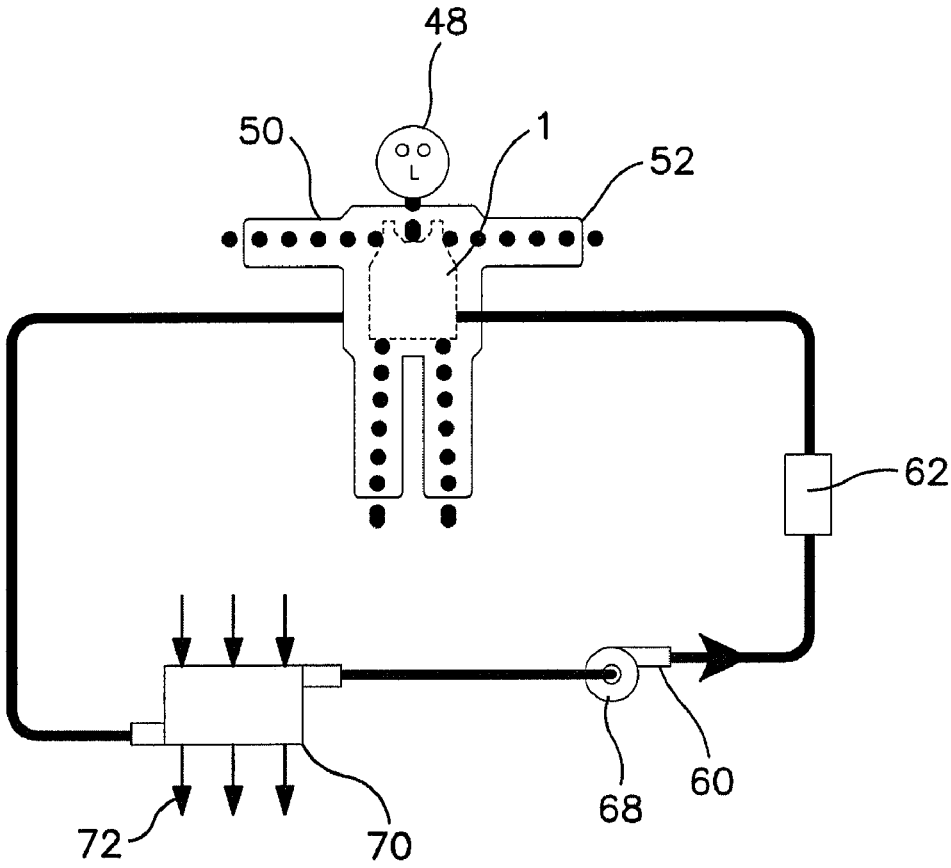
FIG. 14 is a schematic of a gas distribution garment connected to a cross-flow drier gas conditioning component.

In an alternate embodiment the present invention is directed to a gas distribution system comprising is a gas distribution cooling garment 1 incorporating a gas conditioning component 58 and a gas blower 60 as exemplified in FIGS. 12 and 14, and the examples of the present invention. The gas flow path is indicated in FIG. 12 by the arrow. Optionally, a gas flow meter 62 can be included in the gas distribution system to monitor the gas flow rate into the gas distribution cooling garment 1. Gas conditioning components may be provided to improve the quality of the gas that is distributed within the gas distribution garment. Depending on the requirements of the application, the function of the gas conditioning component may include particulate filtration, chemical adsorption, dehumidification, cooling, or heating or a combination thereof.

In closed loop systems such as that depicted in FIG. 12 and exemplified in Examples 4, 5, and 6, water vapor pressure may increase in the gas distribution system as water from the wearer's body is absorbed into the circulating gas stream. To maintain high cooling efficiency, it is preferred to circulate a low water vapor pressure gas stream. Therefore, one embodiment of the present invention incorporates a gas conditioning component capable of removing water from the gas stream. By lowering the water vapor pressure in the gas stream circulating around the wearer, evaporation of water from the wearer's body can be enhanced, enhancing cooling to the subject.

In one embodiment comprising a gas conditioning component, a desiccant drier is provided to remove water from incoming gas. In another embodiment, a phase change material is concurrently provided to the gas conditioning component to absorb heat generated as the desiccant adsorbs water. U.S. Pat. No. 6,858,068 hereby incorporated by reference describes a desiccant/phase change material drier that can be adapted for use in a conditioned gas distribution system of FIG. 12.

A further embodiment of the present invention incorporates a cross flow desiccant drier in fluid communication with a gas distribution garment as exemplified in FIG. 14, in which the primary gas flow path is indicated by the arrow. A cross flow desiccant drier 70 further provides a secondary gas flow 72 across the desiccant bed to remove the heat generated within the desiccant from the adsorption of water. In this embodiment, the secondary gas flow 72 is isolated from the primary gas flow that is in fluid communication with the gas distribution cooling garment 1. Any suitable desiccant drier that is capable of reducing the water vapor pressure from the incoming gas stream may be used in combination with the gas distribution system of the present invention.

Figure 13:
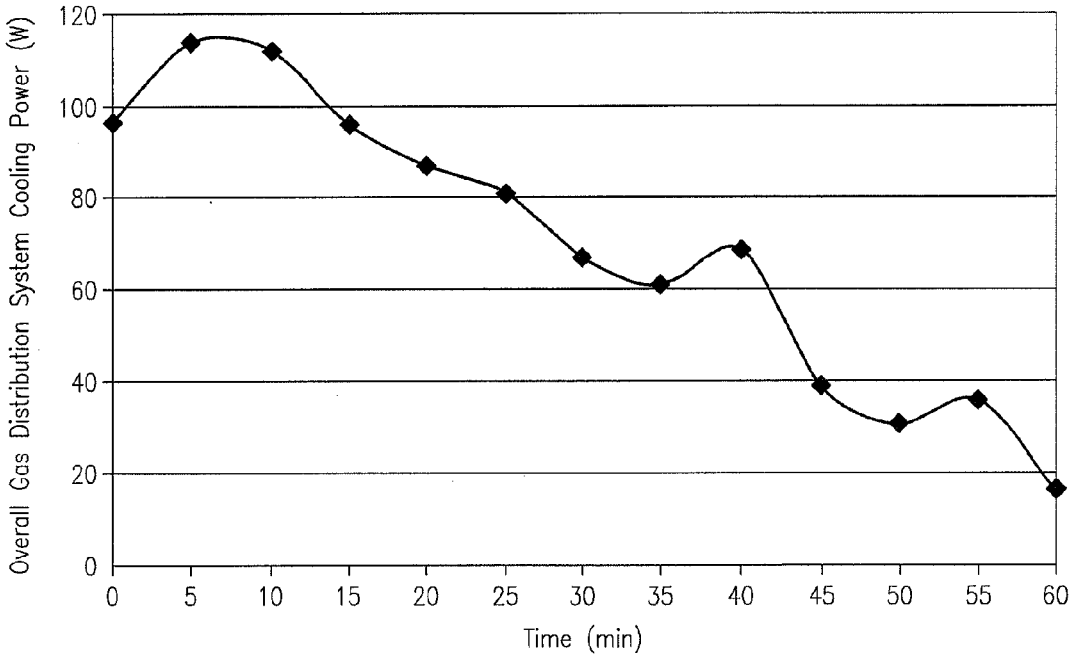
FIG. 13 is a graphical representation of cooling power resulting of an embodiment of the present invention.
Figure 15:
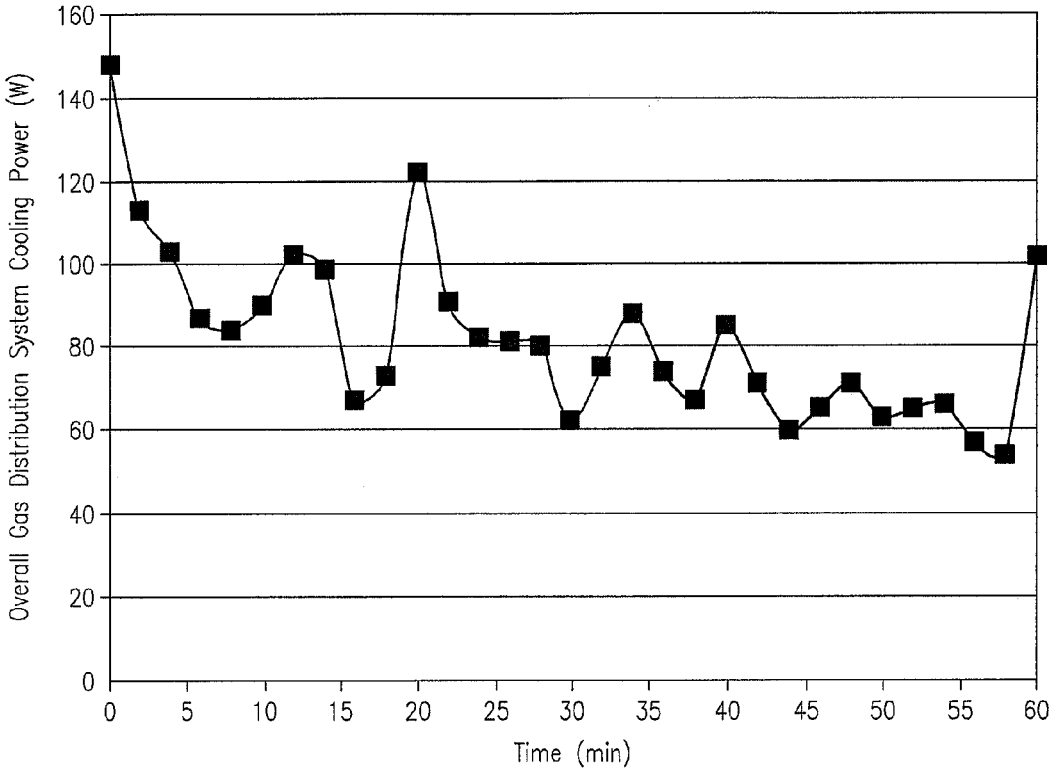
FIG. 15 is a graphical representation of cooling power resulting of an embodiment of the present invention.
Figure 16:
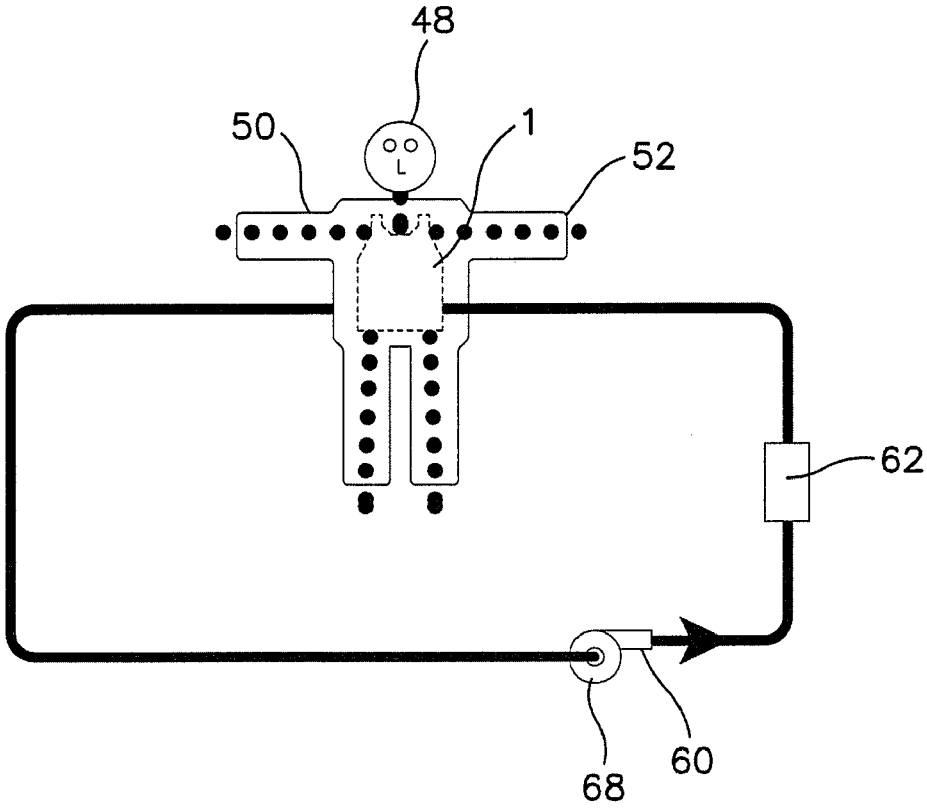
FIG. 16 is a schematic of a gas distribution garment without a gas conditioning component.

The performance of a gas distribution system of the present invention comprising a gas conditioning component can be compared to the performance of a gas distribution system without a gas conditioning component shown in FIG. 16. In trials run at about 35° C. and about 50% relative humidity, systems incorporating gas condition components such as have been exemplified in FIGS. 13 and 15 provided greater cooling than an equivalent construction in the absence of a gas conditioning component as exemplified by FIG. 17.

An alternate embodiment of the present gas distribution system is one in which the gas conditioning component in fluid communication with the gas distribution vest changes the temperature of the incoming gas stream. In one embodiment, the temperature of gas is increased. Depending on the environment, it may be desirable to isolate the circulating gas flow from the heat source. The primary requirement for such an isolated gas flow system is that the gas flow and the heat source are in thermal communication. Materials suitable for this purpose include those having a high heat capacity, exothermic heats of reaction, or that can dissipate heat in a controlled manner. For example, iron oxide packets such as those sold by Grabber Performance Group (Grand Rapids, Mich.), under the tradename MyCoal Heat Treat, can be used to as the gas conditioning medium. Alternatively, the temperature of the gas stream can be increased or decreased, for example, by the incorporation of an adsorption unit, such as that listed in U.S. Pat. No. 6,532,762 hereby incorporated by reference, into the gas conditioning component.

EXAMPLES

Example 1

To demonstrate the efficacy of an embodiment of the invention a garment was constructed according to the teaching of this specification and its cooling effectiveness evaluated whilst being worn by a human subject walking on a treadmill.

The first and second substrates comprised a laminate of Basofil® spun bonded non-woven textile and expanded polytetrafluoroethylene having an air-impermeable water vapour permeable coating with a plurality of foamed silicone rubber protrusions uniformly distributed on the Basofil® surface. The laminate is available from W.L. Gore and Associates GmbH, Putzbrunn, Germany under the trade name Airlock® Part No. AIRL 002000. The silicone rubber protrusions are approximately 3 mm in height and cover an area of approximately 13% of the surface of the laminate.

Two pieces of Airlock® AIRL 002000 laminate were cut and sized according to FIG. 2 to give a body coverage of about 0.45 $m^2$. The laminate corresponding to the second substrate of the invention was perforated with a 1.34 mm diameter needle to give a grid pattern of holes on an approximately 6 mm by 10 mm spacing. The air permeability of the laminate resulting from the perforations was about 60 $l.m^{-2}s^{-1}$ at a pressure drop of about 100 Pa.

The cut pieces of laminate were oriented according to the arrangement in FIG. 4 and attached round their periphery by sewing, thereby forming a cavity. A gas distribution manifold of the general arrangement of FIG. 7 was formed from two lengths of 25 mm inside diameter cylindrical cable duct (Part No. 364-3458 from RS Components Ltd. Corby, Northants, England) corresponding to members 19 and 20 of FIG. 7. The length of each member was about 460 mm. A uniform series of approximately 4 mm diameter holes were drilled in the surfaces of the duct corresponding to surfaces 22, 23, 24 and 25 of FIG. 7 to give 92 holes per member. The ends of the duct within the cavity were sealed with blanking pieces and the other ends terminated in a union piece and gas entry duct corresponding to 27 and 26 respectively of FIG. 7. An electrically powered fan, (Part No. U97EM-012KK-3 from Acal Radiatron, Egham, Surrey, England) was connected to the gas duct to complete the assembly. During the evaluation trials, for convenience, the fan was powered from a bench mounted power supply unit adjusted to provide about 15 Volts dc to the fan. With this set up the airflow from the fan was calculated by measuring the pressure drop across the fan and comparing this with the pressure drop versus flow from the manufacturers data sheet for the fan. The flow was ascertained to be about 10 liters/sec.

For the evaluation trials the subject was clad in the following manner. The subject was dressed in a cotton T-shirt and cotton briefs next to the skin. The cooling garment of Example 1 was provided over the T-shirt. Over the cooling garment, a British Army Mk IV protective suit was provided. Finally, on top of the protective suit, a British Army MK I Fragmentation vest was provided. The feet were covered in socks and heavy boots, and the hands were covered with lightweight cotton gloves under rubber gloves. A respiration mask was placed on the face of the subject.

Three evaluation trials were performed in the following manner.

Trial 1—Subject clad as above with fan running (i.e. cooling in operation).

Trial 2—Subject clad as above with fan switched off (i.e. no cooling).

Trial 3—Subject clad as above but cooling garment removed (i.e. garment ensemble as currently used by military personnel remained).

The subject was tasked to walk on a tread-mill set at a linear speed of about 4.5 km/hr and the subject's body core temperature and heart rate monitored and recorded. The duration of each trial consisted of periods of about 100 minutes of walking followed by rest periods of about 30 minutes. The evaluation trials were carried out in an environmentally conditioned room at an ambient temperature of approximately 35° C. and a relative humidity of 50%.

Figure 8:
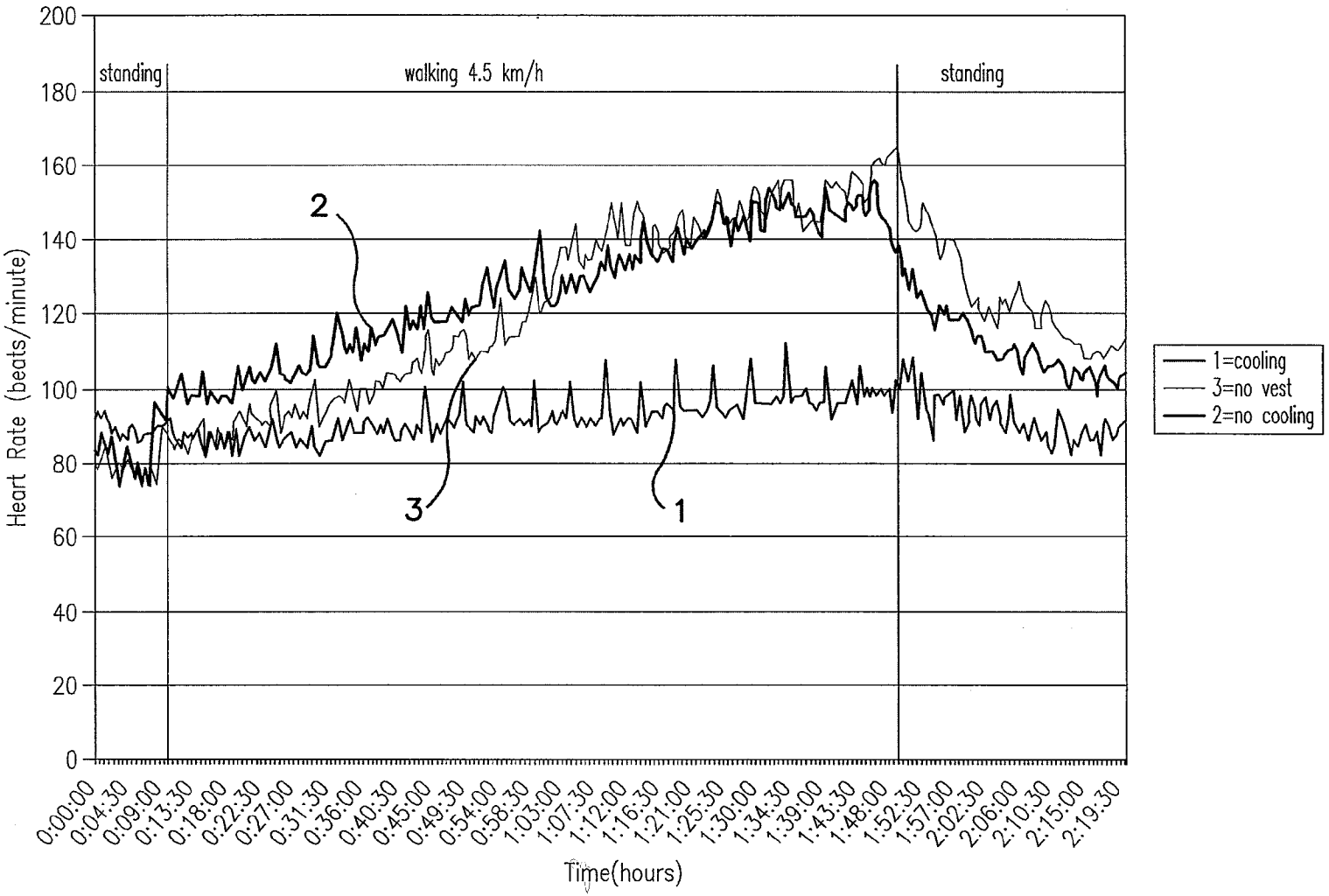
FIG. 8 shows graphical plots of heart rate (beats/minute) versus time (hours) for a human subject in evaluation trials of an embodiment of the invention.
Figure 9:
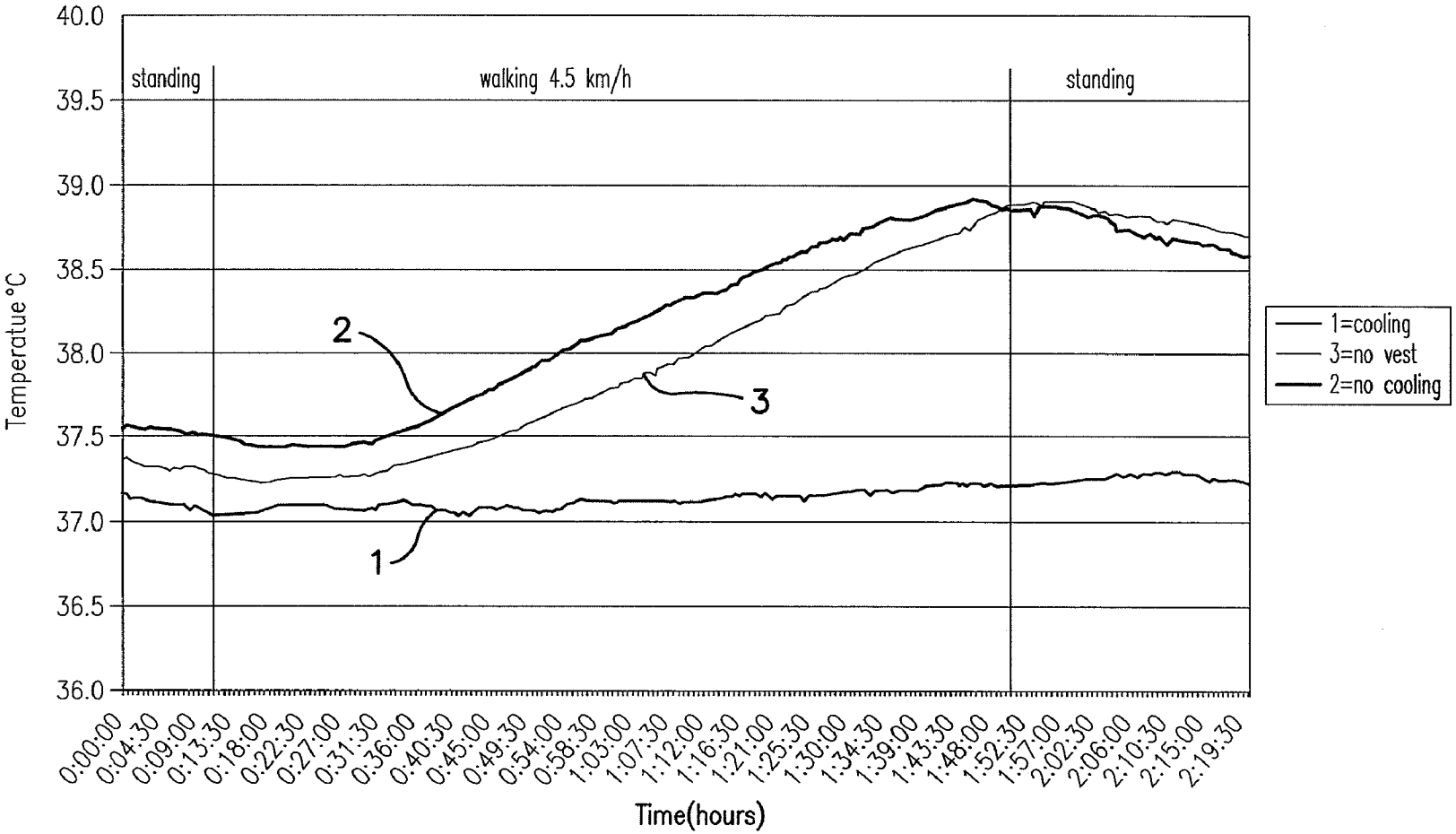
FIG. 9 shows graphical plots of body core temperature for a human subject in evaluation trials of an embodiment of the invention.

The plot of heart rate versus time and the plot of body core temperature versus time for all three trials are shown respectively in FIGS. 8 and 9. Referring to FIG. 8, the plot of heart rate (beats/minute) versus time (hours), shows the highly significant cooling effect of the garment of the invention. The plot of heart rate against time for the subject with the garment in cooling mode ("cooling" plot) corresponding to Trial 1 shows a slight overall rise in heart rate (from approximately 80 beats per minute to approximately 100 beats per minute) throughout the duration of the trial. The regular peaks in the plot correspond to the exercise periods but, with the cooling in operation, the rate drops back to substantially the base level during the rest periods. In contrast, however, the heart rate plots for the "no cooling" and the "no vest" modes (Trials 2 and 3) result in regular rise in heart rate throughout the trials from approximately 80 beats per minute to highly undesirable rates of 160 beats per minute.

The close correlation between the plots for Trials 2 and 3 does however demonstrate another highly desirable feature of the invention i.e. that even when the garment is worn without it being cooled it adds little or nothing to the thermo-physiological load on the wearer compared with the clothing ensemble not including the cooling garment.

The body core temperature plots in FIG. 9 further confirms the effectiveness of the cooling garment of the invention. The "cooling" plot shows the very small rise (less than about 0.5° C.) in the subject's body core temperature. In contrast, the "no cooling" and "no vest" plots corresponding to Trials 2 and 3 show highly undesirable increases of almost 2° C. However, as with the heart rate plots, the body core temperature plots demonstrate the negligible thermo-physiological loading characteristics of the garment when worn without the cooling in operation.

The objectives of the invention are also clearly achieved by the garment of the above example. Whereas in the foregoing trials the fan was powered by a bench mounted power supply unit it has been shown that a battery powered fan could be used and the same air flow rates achieved. The fan of the example was replaced by a fan requiring only a 5 Volt dc supply (Part no. U97LM-005K1 from Acal Radiatron, Egham, Surrey, England) and the replacement fan powered by a nominally rated 6.4 Volt battery with an under-load voltage of 5.0 Volts (Part no. U3356H/2/7, from Ultralife Batteries Ltd. Abingdon, Oxfordshire, England.) The fan gave an output of about 6 liters/sec for over 9 hours.

The garment of the example with the fan and battery attached weighed approximately 2.1 kg, which is considerably less than the 3 kg target for a lightweight system.

Example 2

Cooling

To evaluate the cooling power of the cooling garment prepared substantially according to Example 1, it was subject to Thermally Instrumented Manikin testing by The Cord Group Ltd., Dartmouth, Nova Scotia, Canada. The cooling garment was tested in combination with a standard British Army Mk IV protective suit as used in the foregoing Example 1 and under the various conditions as detailed in the following Table 1. Testing was carried out in a temperature and humidity controlled room with an ambient temperature set at 35° C. and relative humidity set 50%. Details of the test methodology are as follows.

Test Method

The evaluation of cooling vest prototypes using UK standard suit ensemble was conducted using a Thermal Instrumented Manikin Test System. During the testing, environment temperature, skin temperature and power consumption were recorded.

The Thermal Manikin Test System consists of a hollow aluminium manikin equipped with temperature sensors and electric heaters connected to a computer system. The manikin was dressed in the human-use apparel to be tested and placed in an appropriate environment. The computing equipment controlled the heaters to maintain the skin of the manikin at a set temperature and measured the electrical power required to do so. This power is equivalent to the heat that escaped through the clothing due to the temperature difference across it. The power and the temperature difference were then used, along with the known surface area of the manikin to calculate the thermal resistance offered by the apparel.

The thermal performance of a garment was evaluated by unmanned tests on the whole garment under conditions identical or similar to actual operating conditions. The system employed a life-sized watertight manikin capable of being heated to and maintained at a selected temperature.

The system comprised a Thermally Instrumented Manikin (TIM), a control module, a computer, environmental temperature sensors and cables connecting these components. The manikin was in a shape of human proportions to fit inside the test garment. The combinations of the aluminium shell of the manikin and the output of heaters inside it provided for an approximately uniform temperature over the manikin surface. This temperature is sensed by sensors embedded in the manikin's shell and is then passed to the control module.

The control module housed the programmed data acquisition system, the heater relays and other circuit components. The data acquisition system received data from the temperature sensors on the manikin and controlled the heater relays so that the manikin surface temperature remains constant. It also measured the environment temperature and the power applied to the manikin and was programmed with the surface area of the manikin. With this temperature, power and area data, it calculated the insulation value of the garment and passed this, along with other pertinent data to the computer. The computer acted as a control and display terminal and post-processor.

The following clothing combination was used for testing. The manikin was first covered in a shirt with long sleeves and trousers assembled into a coverall (skin) made of an interlock knit (high stretch), white 100% cotton textile. Tubes for the distribution of water were sewn into the garment. Depending on the test set-up as described in Manikin Set Up, A through E, of Table 1 cooling garments prepared according to Example 1 (two styles) were selected and optionally provided over the coverall. One style of cooling garment comprised a single entry port manifold (FIG. 6), and a second style of cooling garment was provided with a split manifold (FIG. 7). An outer layer comprising a UK Standard protective suit ensemble top and bottom, and a Mk I ballistic vest, was provided over the cooling garment, or depending on test conditions, directly over the coverall (skin). Garment openings were secured as follows. Arm cuffs were tucked and secured with elastic straps; front zippers were secured to the top; and bottom of legs were secured with elastic straps. Tensioning straps on the ballistic vest were secured.

The manikin was lifted into a vertical position and suspended in the test chamber hanging from a head bolt with feet lightly touching the floor. Environmental sensors were suspended around the manikin to detect the environment temperature. The manikin temperature was set at about 35.0° C.

The ambient temperature of the chamber was set at about 35° C. and actual temperature was measured at about 34.16-34.31° C. The ambient relative humidity of the chamber was set at about 50% about and measured at about 48.5-56.0%. Water, fed to the cotton garment by way of the tubes, was provided to simulate wetting by sweat. A warm-up period was provided to allow the manikin to reach the set temperature and go into test period. The long-term power was monitored for all calculated sections until steady state condition was reached, and the test was restarted.

The steady state long term power results of the thermal instrumented manikin with and without gas distribution vests of the present invention and standard British protective suit ensemble is as follows.

TABLE 1

| Manikin | | | Long Term Power (watts) | | | | |
|---|---|---|---|---|---|---|---|
| Set Up | Description | Air Flow l/s | Front* | Back** | Arms | Legs | Overall |
| A | Protective suit with ballistic vest, skin wet, no cooling vest, no cooling baseline | 0 | 3.42 | 1.10 | 23.88 | 41.30 | 69.71 |
| B | Protective suit with ballistic vest, skin wet, split duct cooling vest, no cooling | 0 | 2.70 | 1.17 | 21.40 | 42.92 | 68.19 |
| C | Protective suit with ballistic vest, skin wet, split duct cooling vest, cooling @ 15 v dc | 9.28 | 41.45 | 49.74 | 24.78 | 102.39 | 218.36 |
| D | Protective suit with ballistic vest, skin wet, CZ15 single entry cooling vest, cooling @ 15 v | 9.36 | 46.17 | 49.51 | 32.46 | 93.68 | 221.82 |
| E | Same as test number D with backpack added with 102 lbs contained in pack | 8.71 | 44.79 | 47.45 | 26.67 | 94.59 | 213.50 |

Front* - Consists of chest and abdomen sections of the manikin
Back** - Consists of back and buttocks sections of the manikin Table 1 illustrates the significant overall cooling power of the cooling garment of the present invention when energized in cooling mode. Furthermore, a comparison of the results of Manikin Set Ups A and B demonstrates the minimal additional thermal stress added to the Thermally Instrumented Manikin by the cooling garment system of the invention when the garment is not energized for cooling.

Conformability

Conformability of the garment of the present invention was tested and compared with a mesh spacer material representative of those used by garments of the prior art. A sample comprising Airlock® Laminate AIRL 02000 was prepared according to the air permeable second substrate of Example 1 having a plurality of protrusions and perforations, and was tested and compared with spacer material from Mueller Textile Germany, Mueller Part no. 5911.

Test Method

The test method used was performed substantially as described in ASTM D 4032-94 (as re-approved in 2001)—Standard Test Method for Stiffness of Fabric by the Circular Bend Procedure, with the following modifications. The size of the test sample was 4 inches by 4 inches (100 mm by 100 mm) an Instron Model 1011 tensile/compression tester operating with Instron Series 9 software replaced the force measurement gauge; and the plunger speed was set at 500 mm/min.

The Airlock® laminate was tested in three different modes, as follows:

Trial 1: laminate was tested on its own with the protrusions facing downwards in contact with the test platform;

Trial 2: laminate was tested on its own with the protrusions facing upwards in contact with the plunger;

Trial 3: laminate was tested in combination with an 84 g/m$^2$ woven polyester face fabric to simulate a garment construction of the invention.

Five samples of each material were subjected to the conformability test and results are summarized below, in Table 2.

TABLE 2

| | Material: | | | |
|---|---|---|---|---|
| | AIRL 02000 | AIRL 0200 | AIRL 02000 (Trial#) | Spacer material |
| | (Trial 1) | (Trial 2) | (Trial 3) | (Mueller 5911) |
| Average peak force (kg) | 0.010 | 0.011 | 0.009 | 0.049 |

The differences between the conformability of the materials of the present invention compared with other spacer material are clearly demonstrated by this test. Materials having lower average peak force values are deemed more conformable than materials having higher average peak force values. Thus, preferred embodiments of the present invention comprise a conformability peak force value of preferably less than or equal to 0.03 kg, more preferably less than or equal to 0.02 kg, and further preferred, less than or equal to 0.01 kg, for a substrate comprising a plurality of raised protrusions on a substrate surface, when tested according to the method provided herein.

Example 3

Another embodiment of the present invention was constructed comprising a cooling vest made substantially according to Example 1 above except where noted and with the addition of spacer elements.

The vest had a body coverage area of about 0.35 $m^2$. The air permeability of the second substrate was about 20 $l.m^{-2}s^{-1}$ at a pressure drop of about 100 Pa. Spacer elements comprising a series of gas flow enhancing springs 30 were incorporated into the vest substantially as shown in FIGS. 10 and 11. Springs 30 comprised of polyvinylchloride (manufactured by Plastikoil, Winnipeg, Canada) were obtained from Factory Express (Albuquerque, N. Mex., part no. 1200) and had a diameter of approximately 6 mm. The springs were held in place in the cavity by a support mesh 31 (Part No. N03007/09-45PP by DelStar Technologies, Inc., Middletown, Del., USA). A manifold was provided as described in Example 1 above.

An electrically powered fan as described in Example 1 was connected to the gas duct 32, with the inclusion of a flow meter (Part No. Y630 Flowcheck from ACAL Radiatron, Egham, Surrey, England) disposed between the electrically powered fan and the gas duct. The flow rate to the cooling vest was set to 7.5 liters/second at the start of the test period.

The amount of input power required to generate a certain flow rate is determined in part by the resistance of the system to the flow of gas. Backpressure is a measure of this resistance. The backpressure of the vest according to this example was compared to an identical vest without the inclusion of spacer element springs around the abdomen. The experimental setup consisted of a human subject clothed substantially in accordance with Example 1 tested wearing the vest of the present example and a vest without spacer element springs. The gas flow was initiated. After one minute, the backpressure was measured at the inlet 34, of the vest using a pressure meter (Part No. 2081 P by Digitron, Torquay, Devon, England). The backpressure in the vest without the spacer element springs 30 was 4.5 mbar. The same gas flow rate could be achieved with a back pressure of just 2.9 mbar in the vest having the spacer element springs 30.

Example 4

Another embodiment of a forced gas cooling system of the present invention was constructed comprising a portable desiccant/phase change material ("PCM") drier and a forced gas cooling vest. Experiments were conducted to determine the amount of cooling that could be achieved from this forced air cooling system as a function of time.

The PCM drier used in this embodiment was substantially the same as taught in Example 1 of U.S. Pat. No. 6,858,068 to Nanopore, Inc. A forced gas cooling vest was provided that was made substantially in accordance with Example 1 of the present invention and had a total effective vest surface area of 0.7 $m^2$. The gas supply for this forced air cooling system embodiment was provided by a blower capable of providing up to 10 liters/second of air flow at a pressure of at least 5 millibar. Blowers meeting these requirements are available from Acal Radiatron (Egham, Surrey, England; part no. U97EN-012KK-3). Adapters were developed to direct air from the inside an air impermeable coverall to be drawn by the blower through the PCM drier and into the forced gas cooling vest which was worn by a sweating Thermal Manikin as described in Example 2 inside the coverall. The air flow was monitored and maintained at the desired flow rate at inlet to the vest.

The performance of this embodiment of a PCM dried forced air cooling system was determined at CORD Group Ltd (50A Mount Hope Ave, Dartmouth, Nova Scotia B2Y4K9 Canada) using an instrumented sweating Thermal Manikin. FIG. 12 illustrates the experimental setup which consisted of the manikin 48 dressed with a cooling vest 1 over which in an air impermeable coverall 50 (NORTH®, style Tyvek® QC, model number 65595, size L) was worn. The extremity openings of the wrist, neck, and ankles were tape sealed to the external environment 52. The coverall 50 was modified to allow the pass-through of two air ducts which were also tape sealed. One of these ducts was connected to the cooling vest inlet 54 on the inside of the coverall. The second duct was an outlet duct 56 that penetrated about 0.5 inches into the coverall interior to allow it to draw air from inside the coverall. The ends of these two ducts were connected in series with a PCM drier 58 a blower 60 and a flow meter 62 to form a closed air loop. The PCM drier inlet 66 was connected to the coverall discharge duct and its outlet 64 connected to the inlet 68 of the air blower. The outlet of the blower was connected to the vest supply duct with an inline air flow meter 62.

The flow rate to the cooling vest was set to 4 liters/second at the start of the test period. Data were logged starting after the first five minutes of run time to maintain steady state air flow through the system. The manikin was instrumented to record the overall body cooling power. The cooling power of the gas distribution system is based upon the measurements of the electrical energy required by the internal manikin heater elements to maintain a constant manikin skin temperature of 35° C. under test conditions. The manikin was located inside a climate controlled chamber set to 35° C. and 50% relative humidity.

FIG. 13 is a graphical representation plotting the overall gas distribution system cooling power measured by the amount of watts (W) of energy used over a period of time in minutes (min.). The PCM drier cooling performance was determined by integrating the total area under the curve for one hour, yielding 75 watt-hour. As the desiccant in the drier becomes saturated with water generated from the manikin a reduction in cooling capacity is observed over the test period.

Example 5

A further embodiment comprising the forced air cooling system of the present invention was constructed comprising a portable desiccant/convection cooled ("XFlow") drier and a forced air cooling vest. Experiments were conducted to determine the amount of cooling that could be achieved from this forced air cooling system as a function of time.

Testing was performed by Cord Group LTD (Dartmouth, Nova Scotia Canada) substantially in accordance with the description above in Example 4. The Thermal Manikin was outfitted with a coverall and gas distribution vest both substantially similar to the coverall and vest described in Example 3. The XFlow drier used in this embodiment was developed in conjunction with Nanopore, Inc. (Albuquerque, N. Mex.) and is available as Nanopore experimental part number NPD.MW.003.113005. The experimental setup shown in FIG. 14 was identical to that described in Example 4 with the exception that the XFlow drier 70 was used as the means to dry the air stream. The XFlow drier had an integrated blower providing a constant flow of ambient air flow 72 over the drying unit.

FIG. 15 is a graphical representation plotting the overall cooling power of the gas distribution system of this example as measured by the amounts of watts (W) of energy used over time in minutes (min.). The cooling performance of the system using the XFlow drier was determined by integrating the total area under the curve for one hour, yielding 84 watt-hour. As the desiccant in the drier becomes saturated with water generated by the manikin a reduction in cooling capacity is observed over the test period.

Example 6

Another embodiment comprising the forced air cooling system of the present invention was constructed comprising a forced air cooling vest made substantially according to Example 4 above in combination with a loop for recirculating unconditioned air through the coverall.

Figure 17:
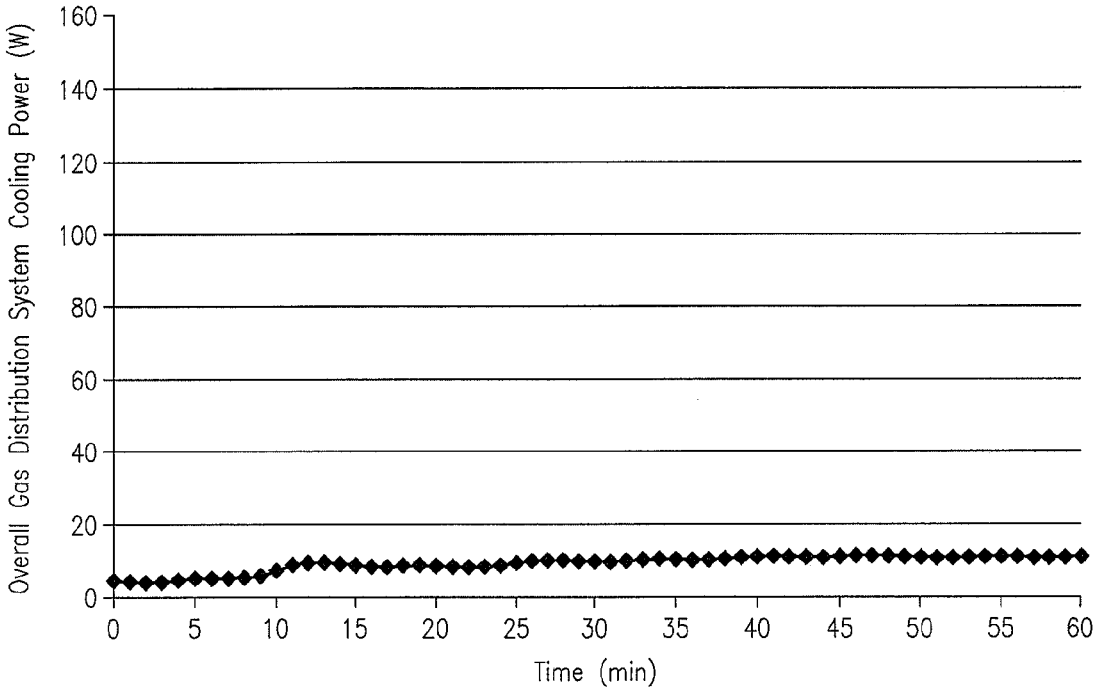
FIG. 17 is a graphical representation of cooling power resulting of an embodiment of the present invention.

An experiment was conducted to determine the amount of cooling that could be achieved from this forced air cooling system as a function of time. The experimental setup is shown in FIG. 16 and was substantially the same as the set-up described in Example 4 above with the exception that there was no means to condition the air stream. FIG. 17 is a graphical representation plotting the overall cooling power of the gas distribution system of this example as measured by the amount of watts (W) of energy used over time measure in minutes (min.) obtained. The performance was determined by integrating the total area under the curve for a 60 minute period, yielding 9.2 watt-hour.

Whereas the foregoing examples are demonstrative of a specific embodiment of the invention it should not be deemed to be limiting in scope. One skilled in the art will select other embodiments, designed for specific end uses. For example an embodiment of the invention intended for use by fire fighters and other operatives subjected to fire or other high temperature situations may comprise non-melting and non-flammable materials.

While particular embodiments of the present invention have been illustrated and described herein, the present invention should not be limited to such illustrations and descriptions. It should be apparent that changes and modifications may be incorporated and embodied as part of the present invention within the scope of the following claims.

We claim:

1. A garment for cooling a body of a wearer comprising:

a substantially gas impermeable first substrate and a gas-permeable second substrate attached around their peripheries forming a cavity there between, at least one spacer element disposed within the cavity, wherein the at least one spacer element is a helical coil, and a plurality of raised protrusions on the gas permeable second substrate on the surface external to the cavity and proximate to the body of the wearer;

wherein the cavity is adapted to be connected to a gas supply such that the gas flows into the cavity and exits the cavity through the gas permeable second substrate.

2. The garment of claim 1 wherein at least one of the first and second substrates comprises a plurality of raised protrusions on a surface within the cavity.

3. The garment of claim 1 wherein at least one of the first and second substrates comprises a plurality of raised protrusions on a portion of a surface within the cavity.

4. The garment of claim 1, wherein at least one of the first and second substrates comprises a plurality of raised protrusions on a portion of a surface within the cavity adjacent the spacer element.

5. The garment of claim 1 wherein at least one spacer element is disposed in a first region within the cavity.

6. The garment of claim 5 comprising a plurality of raised protrusions on at least one of the first and second substrates in a second region within the cavity.

7. The garment of claim 1, wherein at least one spacer element is disposed in the cavity in a region subject to compression by the body of a wearer.

8. The garment of claim 1 wherein the at least one spacer element has a height between about 3 mm and 30 mm.

9. The garment of claim 1 wherein the at least one spacer element has a height between 4 mm and 20 mm.

10. The garment of claim 1 wherein the at least one spacer element has a height greater than the height of the raised protrusions.

11. The garment of claim 2, wherein the spacer element has a height greater than the height of the raised protrusions within the cavity.

12. The garment of claim 1 wherein the at least one spacer element comprises a plurality of helical coils.

13. The garment of claim 1 wherein the at least one spacer element further comprises a three-dimensional mesh.

14. The garment of claim 1 wherein the at least one spacer element is load bearing.

15. The garment of claim 1 wherein the at least one spacer element is supported within the cavity.

16. The garment of claim 1 wherein the at least one spacer element is affixed to at least one of the first and second cavity substrates.

17. The garment of claim 1 further comprising a support layer for securing the position of the at least one spacer element within the cavity.

18. A garment system comprising the garment of claim 1 and a gas supply for supplying a gas flow to the cavity.

19. The garment system according to claim 18 further comprising a component in fluid communication with the gas flow for conditioning gas in the system.

20. The garment system according to claim 19 wherein the component is a desiccant in vapor communication with the gas.

21. The garment system according to claim 20 where in the component further comprises a phase-change material in thermal communication with the desiccant.

22. A garment for cooling a body of a wearer comprising:

a substantially gas impermeable first substrate and a gas-permeable second substrate attached around their peripheries forming a cavity there between, at least one spacer element disposed within the cavity, wherein the at least one spacer element is a helical coil, and at least one additional substrate interposed between the body of the wearer and the gas permeable second substrate of the garment, wherein the at least one additional second substrate comprises a plurality of raised protrusions, and, wherein the cavity is adapted to be connected to a gas supply such that the gas flows into the cavity and exits the cavity through the gas permeable second substrate.

23. The garment of claim 22 wherein the at least one additional substrate comprises raised protrusions on the surface proximate to the body of the wearer.

24. The garment of claim 22 wherein the at least one spacer element has a height between about 3 mm and 30 mm.

25. The garment of claim 22 wherein the at least one spacer element has a height between 4 mm and 20 mm.

26. The garment of claim 22 wherein the at least one spacer element comprises a plurality of helical coils.

27. The garment of claim 22 wherein the at least one spacer element further comprises a three-dimensional mesh.

28. The garment of claim 22 wherein the at least one spacer element is load bearing.

29. The garment of claim 22 wherein at least one of the first and second substrates comprises a plurality of raised protrusions on a surface within the cavity.

30. The garment of claim 22 wherein at least one of the first and second substrates comprises a plurality of raised protrusions on a portion of a surface within the cavity.

31. A garment system for cooling a the body of a wearer comprising:

a garment comprising a substantially gas impermeable first substrate and a gas-permeable second substrate attached around their peripheries forming a cavity there between, at least one spacer element having a height between about 3 mm and 30 mm disposed within the cavity, and a plurality of raised protrusions on the gas permeable second substrate on the surface external to the cavity and proximate to the body of the wearer;

a gas supply for supplying a gas flow to the cavity, wherein the cavity is adapted to be connected to the gas supply such that the gas flows into the cavity and exits the cavity through the gas permeable second substrate, and a component in fluid communication with the gas flow for conditioning the gas.

32. The garment system according to claim 31, wherein the component is a desiccant in vapor communication with the gas.

33. The garment system according to claim 32, wherein the component further comprises a phase-change material in thermal communication with the desiccant.

34. The garment system of claim 31 wherein at least one of the first and second substrates comprises a plurality of raised protrusions on a surface within the cavity.

35. The garment system of claim 31 wherein at least one of the first and second substrates comprises a plurality of raised protrusions on a portion of a surface within the cavity.

36. The garment system of claim 31 wherein the at least one spacer element has a height between 4 mm and 20 mm.

37. The garment system of claim 31 wherein the at least one spacer element comprises a helical coil.

38. The garment system of claim 31 wherein the at least one spacer element comprises a plurality of helical coils.

39. The garment system of claim 31 wherein the at least one spacer element comprises a three-dimensional mesh.

40. The garment system according to claim 31, wherein the component changes a temperature of the gas.

41. The garment system according to claim 40, wherein the temperature of the gas is increased.

42. The garment system according to claim 40, wherein the temperature of the gas is decreased.

43. The garment system of claim 31, wherein the conditioning component is a cross-flow desiccant drier.

44. A garment for cooling a body of a wearer comprising:

a substantially gas impermeable first substrate and a gas-permeable second substrate attached around their peripheries forming a cavity there between, at least one spacer element disposed within the cavity, wherein the at least one spacer element is a three-dimensional mesh, and at least one additional substrate interposed between the body of the wearer and the gas permeable second substrate of the garment, wherein the at least one additional second substrate comprises a plurality of raised protrusions, and, wherein the cavity is adapted to be connected to a gas supply such that the gas flows into the cavity and exits the cavity through the gas permeable second substrate.

* * * * *